US007989687B2

(12) United States Patent
Bibollet

(10) Patent No.: US 7,989,687 B2
(45) Date of Patent: Aug. 2, 2011

(54) HARMONICA

(76) Inventor: Jean-Claude Bibollet, Thones (FR)

( * ) Notice: Subject to any disclaimer, the term of this patent is extended or adjusted under 35 U.S.C. 154(b) by 138 days.

(21) Appl. No.: 12/448,202

(22) PCT Filed: Dec. 14, 2007

(86) PCT No.: PCT/FR2007/002070

§ 371 (c)(1),
(2), (4) Date: Jun. 12, 2009

(87) PCT Pub. No.: WO2008/087297

PCT Pub. Date: Jul. 24, 2008

(65) Prior Publication Data

US 2010/0000393 A1 Jan. 7, 2010

(30) Foreign Application Priority Data

Dec. 14, 2006 (FR) ..... 06 10962

(51) Int. Cl.
*G10D 7/12* (2006.01)

(52) U.S. Cl. ..... 84/377

(58) Field of Classification Search ..... 84/375, 84/330, 377–379

See application file for complete search history.

(56) References Cited

U.S. PATENT DOCUMENTS 2,641,950 A * 6/1953 West et al. ..... 84/377
3,516,320 A * 6/1970 Wallace et al. ..... 84/672
3,589,232 A * 6/1971 Peters ..... 84/377

* cited by examiner

*Primary Examiner* — Kimberly R Lockett
(74) *Attorney, Agent, or Firm* — Oliff & Berridge, PLC

(57) ABSTRACT

The blade-holder (3,4) for a harmonica according to the invention supporting at least one vibrating tonal blade (301, 401) comprises air-tightness means formed by side walls (301 L, 401 L) and an end wall (301 E, 401 E) extending in the continuation of the side faces and of the corresponding end face of the window through which the free part of the tonal blade concerned (301, 401) oscillates.

15 Claims, 26 Drawing Sheets

(Cross-section BB)

(Cross-section AA)

(Cross-section according to Px)

Fig. 5 bis (Cross-section FF)

(Cross-section GG)

1

(Cross-section HH)

(Cross-section II)

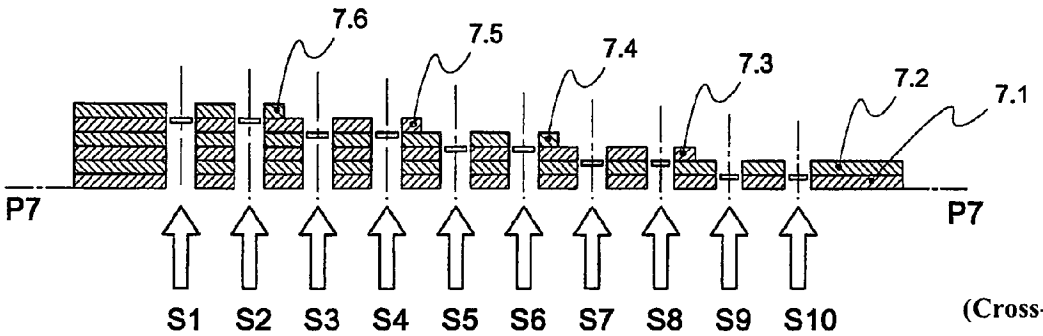
Fig. 11
(Cross-section L1 L1)
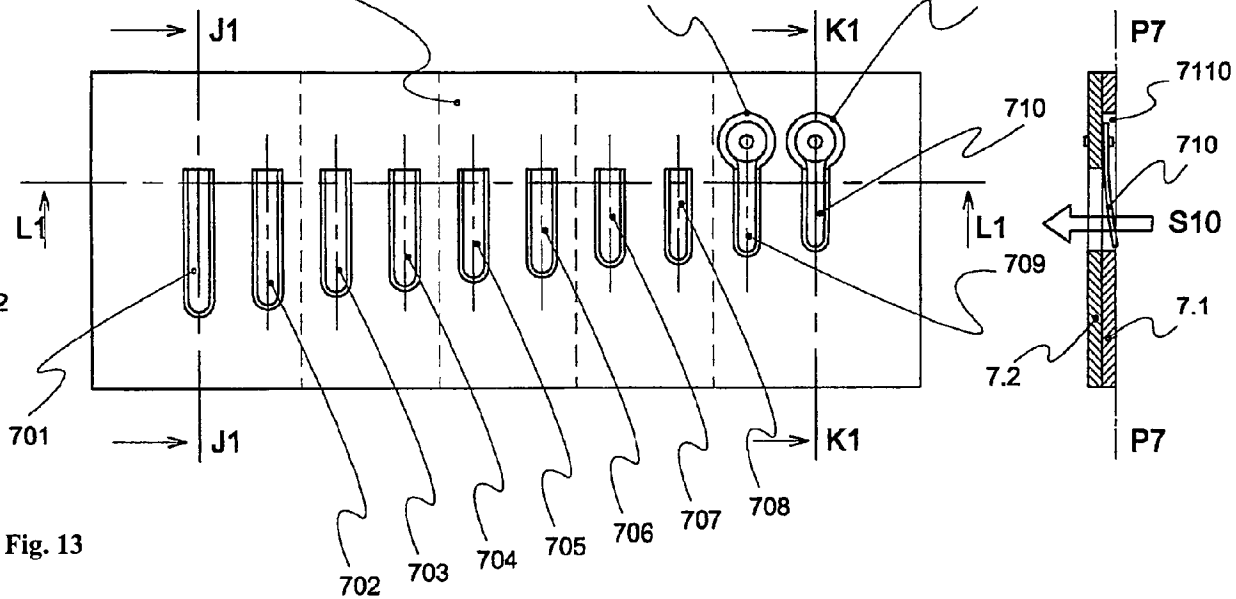
Fig. 13
Fig. 14
(Cross-section K1 K1)
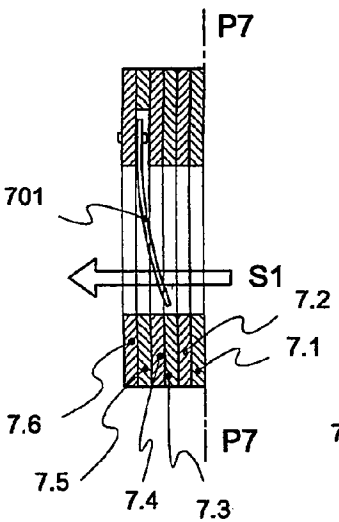
Fig. 12
(Cross-section J1 J1)

(Cross-section K2 K2)

(Cross-section J2 J2)

(Cross-section L2 L2)
P8
A10
A1
A2
A3
A4
A5
A6
A7
A8
A9
K2
J2
L2
810
801
8
8.01
8.02
8.03
8.04
8.05
8.06

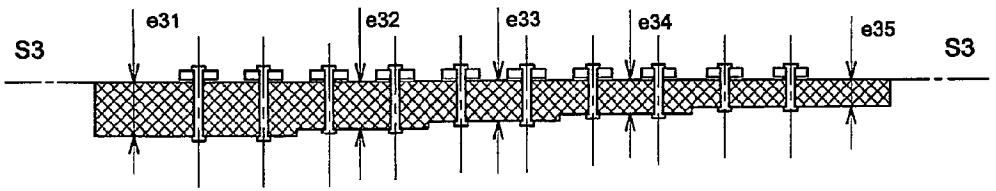
Fig. 19
(Cross-section according to L3 L3)
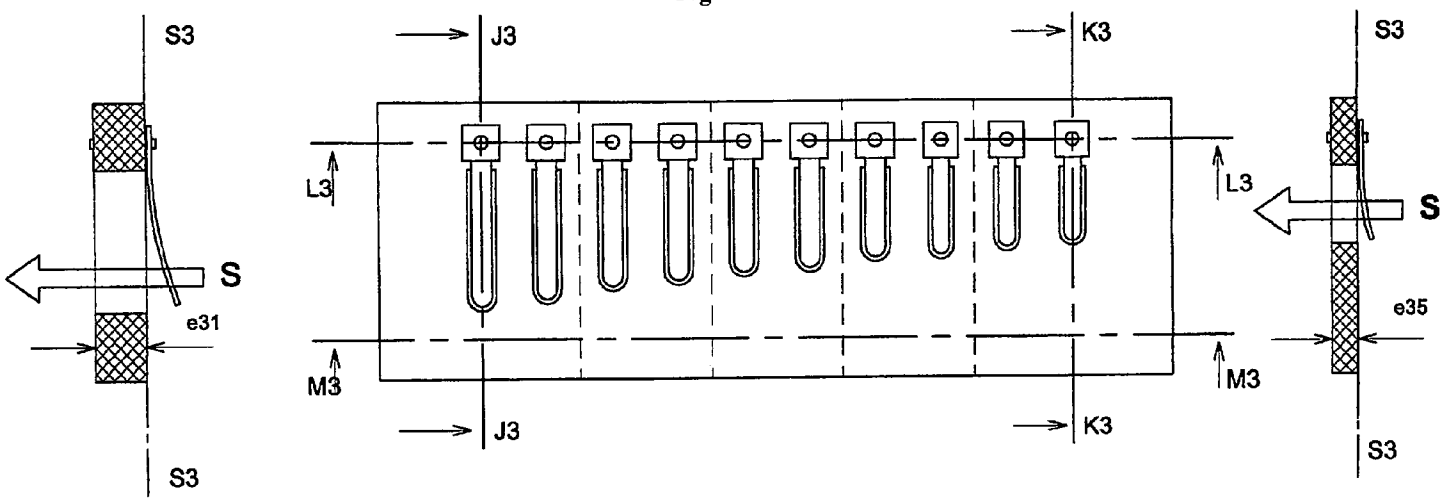
Fig. 20
(Cross-section according to J3 J3)
Fig. 22
(Cross-section according to K3 K3)
Fig. 21
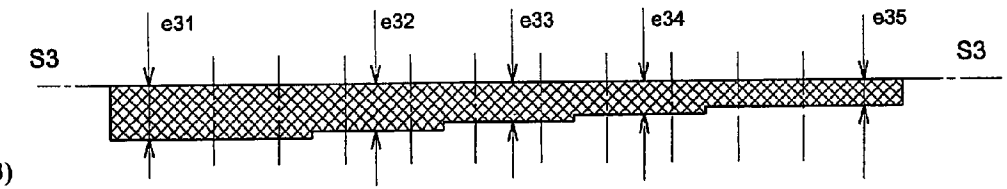
Fig. 23
(Cross-section according to M3 M3)

(Cross-section according to M4 M4)

(Cross-section according to J4 J4)

(Cross-section according to K4 K4)

(Cross-section according to L4 L4)

(Cross-section according to L5 L5)

(Cross-section J5 J5)

(Cross-section according to M5 M5)

(Cross-section according to K5 K5)

(Cross-section PP)

(Cross-section MM)

(Cross-section NN)

(Cross-section OO)
P11
11
A
S
e1
e2
e3
e4
e5
M
N
O
P (Cross-section RR)

(Cross-section RR)

(Cross-section RR)

(Cross-section SS)

(Cross-section QQ)

(Cross-section UU)

(Cross-section TT)

(Cross-section according to Px)

(Cross-section according to Px)

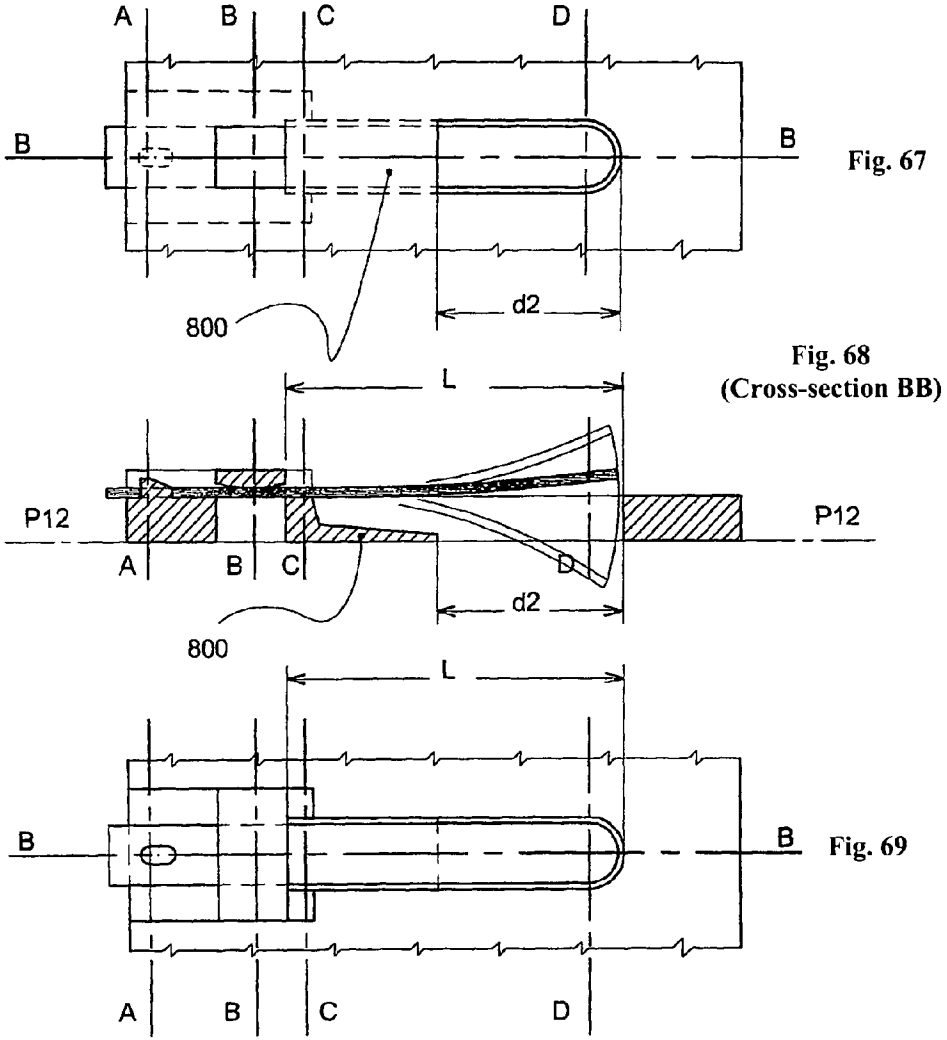
Fig. 67
Fig. 68
(Cross-section BB)
Fig. 69
A
B
C
D
d2
L
800
P12
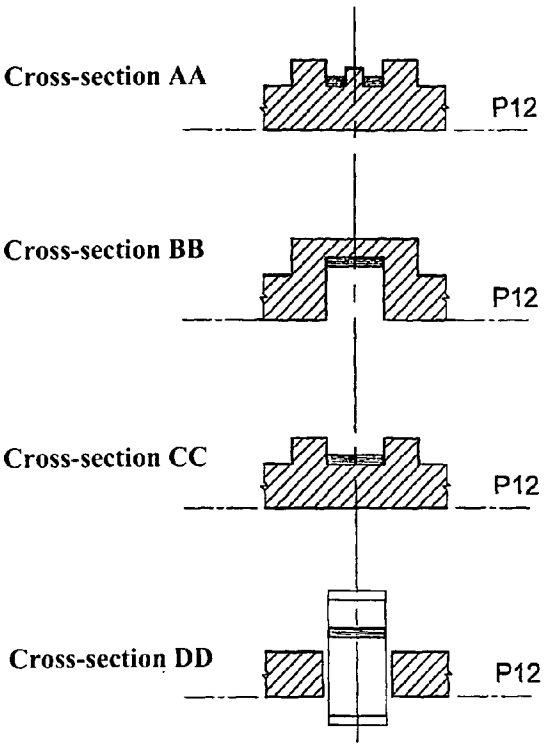
Fig. 66
Cross-section AA
Cross-section BB
Cross-section CC
Cross-section DD
P12

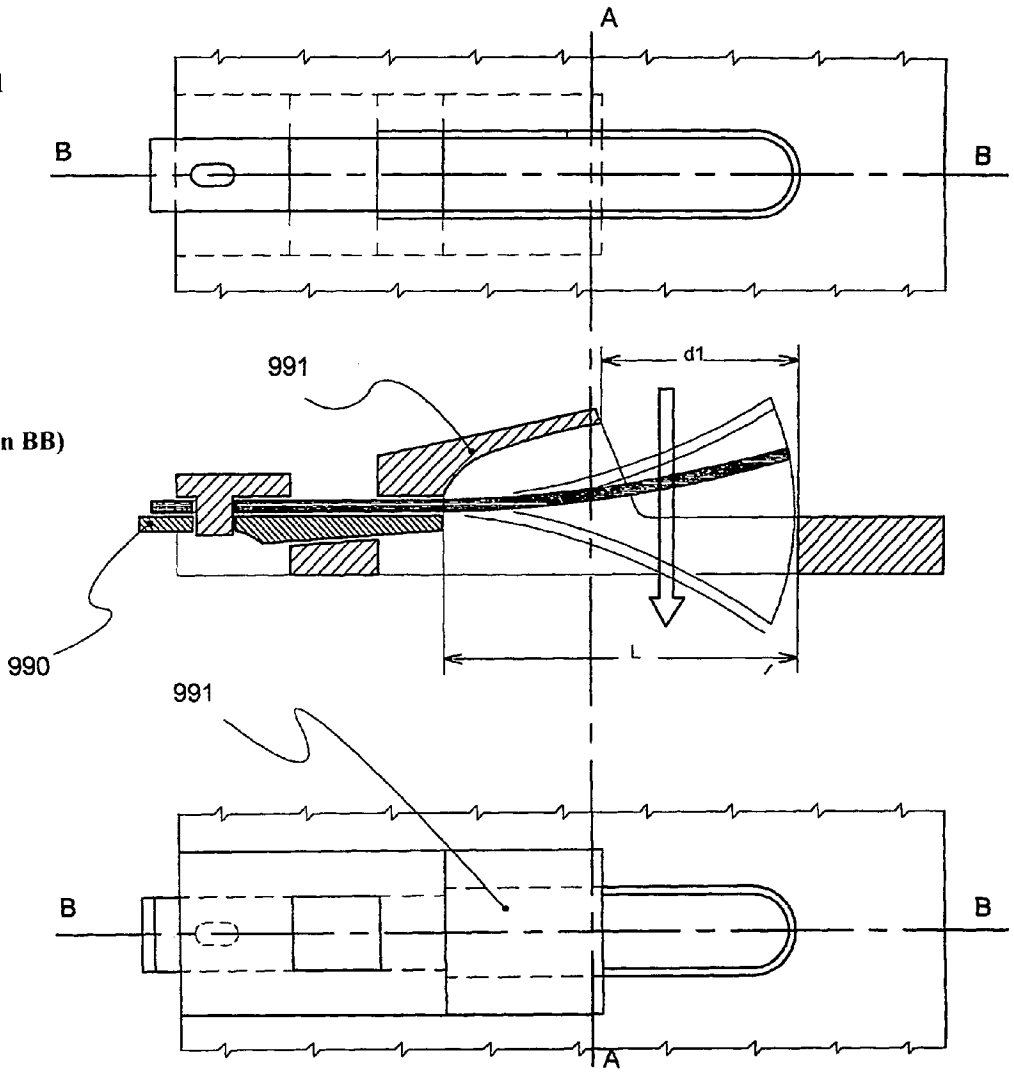
Fig. 71
Fig. 72
(Cross-section BB)
Fig. 73
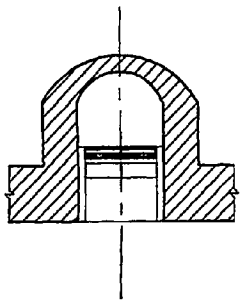
Fig. 70
(Cross-section AA)

(Cross-section AA)

(Cross-section BB)

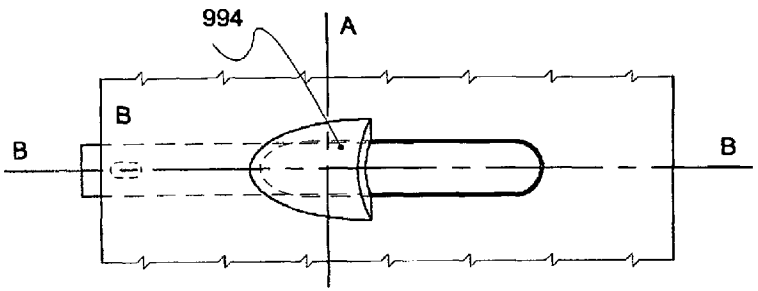
Fig. 80
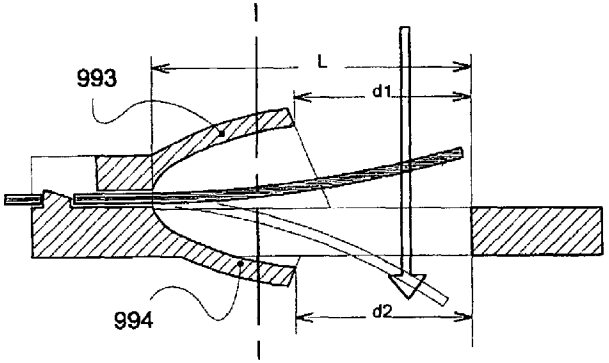
Fig. 81
(Cross-section BB)
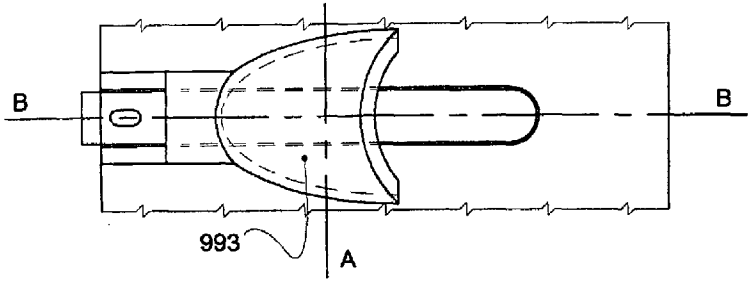
Fig. 82
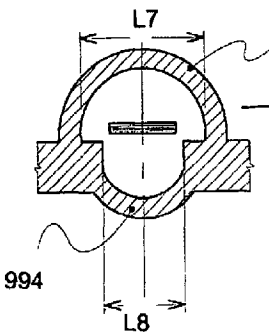
Fig. 79
(Cross-section AA)
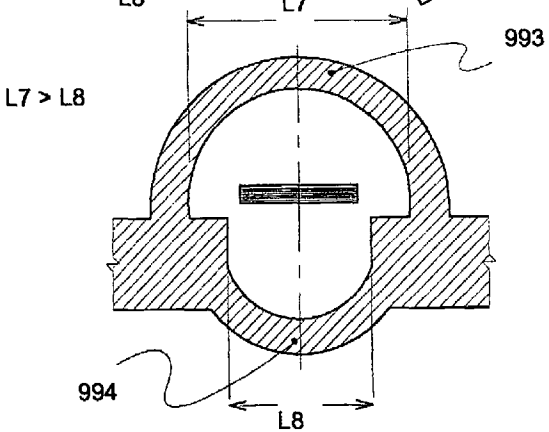

HARMONICA

The present invention relates to an improvement for a harmonica.

A large number of types of harmonicas exist and the main problem encountered with harmonicas of the prior art is linked to the limited tonal reproduction of these instruments due to their very design itself which does not provide a correct tightness able to oppose air leaks. Due to the shape of the vibrating tonal blades which has to be cambered, the air sucked in or blown out can in fact easily escape via the windows through which the tonal blades oscillate by passing between the curved lateral edges of the blades and the face of the blade-holder against which said tonal blades are fixed. Another large source of leakage also resides at the level of the gaping opening located between the free ends of the tonal blades and the face of the blade-holder against which said tonal blades are fixed.

This results in a lack of comfort when playing which both limits the musical performances of the player and above all makes for difficult access to certain particular playing techniques known under the name of fading.

Harmonicas of the prior art are moreover costly to manufacture and not very practical to maintain as access to the internal arrangements of the instrument is difficult.

The arrangements of the instrument proposed in this invention provide a relevant answer to the above-mentioned problems encountered in harmonicas of the prior art.

As a preamble, to facilitate the description and understanding of the present document, the convention is firstly adopted that the part of the instrument in contact with the musician's mouth constitutes the rear part of the instrument whereas the opposite face via which the emitted sounds exit constitutes the front part of the instrument.

A further convention is that the harmonica according to the invention, which can be of symmetrical or non-symmetrical external shape, is here positioned in such a way that its longitudinal mid-plane Px is arranged horizontally, said plane Px being the plane passing substantially at mid-thickness of the instrument and therefore passing substantially at the rear of the harmonica, via the axis of the mouthpiece holes, and passing at the front of the harmonica close to the mid-height of the resonator of the instrument. Naturally in all cases where the whole part of the instrument located above said longitudinal mid-plane Px is identical to the whole part of the instrument located below this longitudinal mid-plane Px, this plane Px then also constitutes the general longitudinal plane of symmetry of the instrument.

The final convention adopted is to call the blades fixed on the face of the blade-holder facing the inside of the air channels blown blades, whereas the blades called sucked blades will be the blades fixed against the face of the blade-holder situated outside the air channels. In the present description, we will therefore not take into account the fact that the blades called blown blades, the main purpose of which is to vibrate emitting a sound when the player blows into the instrument, can in certain playing techniques, come into action even when sucking. The same is true of the blades called sucked blades which can come into action when blowing in certain playing techniques which occasionally make the blades vibrate due to the action of an air flow of opposite direction to that for which they were initially designed but which naturally remains their principal mode of vibration. In the same way, when the text mentions the term air inlet face, this always means the face via which the air enters to pass through the window concerned and on the contrary, when the text refers to the term air outlet face, what is meant is the face via which the air exits after it has passed through said window, again with reference to the sucked or blown type of the blade associated with the window concerned.

These conventions having been set down, the instrument according to the invention is made up of the following elements:

- a main body, the peripheral shell of which body enables the instrument to be held, said main body being formed by a hollow element in the form of an elongate bell the front face of which is open to act as resonator for the instrument. The rear face of the main body, opposite the resonator, constitutes the mouthpiece face of the instrument in which there are arranged the mouthpiece holes through which the musician blows or sucks the air that makes the tonal reeds, or tonal vibrating blades, of the instrument vibrate. The external shell of said main body can be symmetrical or not with respect to the longitudinal mid-plane Px of the instrument,
- An element called wind chest or reed comb located at least partially inside the cavity arranged in the main body. This reed comb, which may form or not a monolithic assembly with the main body, is formed by a plurality of walls that separate the air channels from one another,
- At least one blade-holder held pressing against the corresponding bearing zones of the reed comb, which bearing zones are in particular formed by the edge of the walls separating the air channels from one another.
- Several vibrating tonal blades, of the free reed type, formed by fine blades fixed via one of their ends to the blade-holder by any securing means such as in particular rivets, staples, screws, glue, or soldering points. Under the combined action of the force of the air sucked in or blown out by the musician and of the flexibility of said blades in flexion, the free end of these blades can oscillate on each side of an equilibrium position passing through a window of very slightly larger dimensions arranged through the blade-holder plate concerned.
- Pressure means for the purpose of applying the blade-holder plate or plates against the reed comb, and possibly complementary tightness means to prevent air leaks between the different elements—blade-holder plate or plates, reed comb and main body.

According to a first feature of the invention, if not for all of the vibrating tonal blades of the instrument, at least for some of said blades, to constitute means designed to ensure an optimal tightness by forming chicanes that are as precise and as airtight as possible so as to prevent lateral air leaks between said blades and the corresponding air inlet face of the blade-holder, the harmonica according to the invention comprises walls called lateral tightness walls the face of which oriented towards the blade concerned is positioned substantially in the continuation of the corresponding lateral side formed by the edge of the window through which the free part of the vibrating tonal blade concerned oscillates.

According to another feature, the harmonica according to the invention comprises complementary means to the foregoing means designed to improve the air-tightness preventing air leaks, engaging between the vibrating free end of the tonal blade and the air inlet face of the blade-holder. These means can in particular be achieved by a wall whose face oriented towards said blade is advantageously positioned in the continuation of the end face formed by the corresponding edge of the window concerned. To optimise this end tightness, the end tightness wall is advantageously of curved shape at least in the plane of symmetry of the blade, the curve of said shape being ideally parallel and as close as possible to the curved path described by the free end of the blade in the course of its oscillations. The above-mentioned end tightness wall extends on the side where the camber of the blade concerned is oriented when the latter occupies its rest position, i.e. when it is not activated by any air flow, and this end tightness wall extends beyond the plane passing via the face of the blade-holder against which the tonal blade concerned is fixed.

According to another feature, and according to a first embodiment, the above-mentioned lateral tightness walls and end tightness wall respectively extend the corresponding side walls and end wall of the window concerned beyond the plane passing through the face of the blade-holder against which said vibrating tonal blade is fixed. The above-mentioned continuations extend in the half-space oriented towards the air inlet face towards which the concaveness of the blade at rest is therefore oriented, which is also the half-space in which the free cambered part of said vibrating tonal blade is positioned when the latter occupies its rest position, i.e. when it is not activated by any air flow.

According to an important feature, the above-mentioned continuations of the side and end faces of the windows extend at least up to the level of the cambered concave face of the tonal blade concerned when the latter occupies its rest position, i.e. when it is not activated by any air flow.

According to another feature, to generate a rounder and more powerful tone by means of an outlet aperture that is more limited and opens later when oscillation of the blade concerned takes place, one or more additional plates also comprising windows of suitable dimensions can advantageously be stacked and pressed against the face of the blade-holder on the air outlet face side, i.e. on the side where the face of the blade-holder is located via which the air escapes when passing through said window, so that the faces constituted by the edges of said windows can provide a modulated lateral and end tightness according to the characteristics required for the sound.

According to another embodiment, the above-mentioned lateral and end tightness walls are arranged directly in at least one of the blade-holders of the harmonica and are formed at least partially by the corresponding lateral and end faces of the window concerned, achieved in a blade-holder of sufficient thickness at the level of said window for said lateral and end walls to be able to be sufficiently high to achieve said lateral and end tightnesses by closing all or part of the space comprised in the vicinity of the peripheral edges of the blade concerned when the latter is at rest and the corresponding edges of the window on the side where the air inlet face and/or if applicable the air outlet face is located. Each vibrating tonal blade supported by this blade-holder is fixed to said blade-holder via one of its ends whereas the free part of this tonal blade can oscillate through a window arranged in the blade-holder by the force of an air flow blown or sucked by the harmonica player, and said blade-holder is characterized in that it comprises tightness walls situated substantially in the continuation of the corresponding side walls of the window concerned.

The above-mentioned tightness walls extend on the side where the camber of the blade concerned is oriented when the latter occupies its rest position, i.e. when it is not activated by any air flow, and these tightness walls are extended beyond the plane passing via the face against which the tonal blade concerned is fixed.

According to another embodiment, the above-mentioned lateral and end tightness faces are formed at least partially by the corresponding faces of the edges of the windows arranged in additional plates stacked and pressed against the face of the blade-holder oriented towards the air inlet side, i.e. the side via which the air enters when passing through the window, i.e. therefore the side where the blade-holder face is situated against which the vibrating blade is fixed whether it be of sucked type or of blown type.

According to another feature, the above-mentioned lateral and end tightness faces are formed at least partially by the corresponding faces of the edges of the windows arranged in additional plates stacked and pressed against the face of the blade-holder oriented towards the air outlet side i.e. the side via which the air exits when passing through the window, i.e. therefore the face of the blade-holder opposite which the vibrating blade is fixed whether it be of sucked type or of blown type.

According to a first embodiment, for a vibrating blade concerned, the respective widths of the different windows are identical for all the stacked plates so that the lateral tightness walls thus formed by stacking of the plates are substantially flat and positioned parallel to the plane in which the longitudinal axis of the blade moves when oscillating.

According to another embodiment, for a vibrating blade concerned, the widths of the different windows are increasing with the distance from the face of the blade-holder against which the blade concerned is fixed so that the lateral tightness faces are then stepped, which can prove interesting to avoid undesirable contacts between these lateral tightness walls and the vibrating free part of the blade when the latter oscillates while twisting slightly in certain particular playing techniques.

In embodiments in which the lateral and end tightness means are formed by stacking of plates as defined hereabove, for each blade concerned the respective lengths of each of the windows arranged in said plates can advantageously be decreasing with the distance from the face of the blade-holder against which the blade concerned is fixed, so that stacking of the plates results in a stepped end wall ensuring optimal end tightness by following the curved path described by the end of the blade in the course of its oscillations as closely as possible.

According to another embodiment that may be complementary to the foregoing embodiments, the above-mentioned lateral and end tightness walls are secured to the wind chest of the instrument and/or to the main body of the instrument and/or to the corresponding covers of the instrument, and these tightness walls are therefore at least partially formed by corresponding arrangements of said wind chest and/or of the main body and/or of the cover.

According to another feature of yet another embodiment, the tightness means formed by tightness walls as described above are arranged in an element intercalated between at least one of the blade-holders and the corresponding bearing face of the wind chest. According to a complementary feature of this embodiment, this intercalary element is advantageously made from a slightly flexible material to achieve a good tightness at the level of the faces of the wind chest and of the blade-holder between which it is sandwiched.

According to an important feature, the treble blades being shorter than the bass blades, the respective amplitudes of their oscillations are therefore different when they vibrate, the free part of the treble blades therefore moving less far on each side from the plane passing through the securing face of the blade than the free part of the bass blades, which justifies heights of lateral and end tightness walls in proportion to said blade lengths. For the sound produced by the different blades to be homogeneous with one another, it is therefore very important for the thicknesses of the different zones of the blade-holder in which the windows are cut to be proportional to these amplitudes and therefore in relation with the length of the different blades for a stepped decrease of the height of the lateral and end tightness faces ensured by the corresponding edges of the windows. These differences of thickness of the blade-holder can be obtained either by machining in steps made in the thickness of the plate that constitutes said blade-holder or by stacking of different additional plates of constant thickness or not but of decreasing dimensions, and in particular of decreasing lengths, stacked against the relevant face of the blade-holder to form strata. These different additional plates can be assembled to one another and/or with the blade-holder by sticking, clipping, soldering/welding or any other means of securing which can be either definitive or advantageously temporary to enable said plates to be removed from one another for ease of access to the tonal blades when performing tuning or repair operations.

According to a preferred embodiment, the face of the blade-holder that presses against the wind chest is advantageously flat to enable the required tightness to be easily achieved, whereas the embossments formed by the above-mentioned thinnings of the blade-holder plate are therefore made on the other face of said blade-holder. The face situated on the air inlet side of the blade-holder on which the blown blades are fitted will therefore advantageously be flat, whereas the embossments formed by the above-mentioned stepped machinings will be located on the face of said blade-holder situated on the air outlet side. For the blade-holder supporting the sucked blades on the other hand, the face pressing against the wind chest being the face of the blade-holder situated on the air outlet side, it is therefore advantageously this face which will be flat, the embossments formed by the above-mentioned stepped machinings then being located on the face of said blade-holder situated on the air inlet side.

According to another feature, the edges of certain windows advantageously comprise furrows, chamfers, notches or grooves on the face of the blade-holder facing the air outlet side and/or on the face of the blade-holder facing the air inlet side, designed both to prevent turbulences by facilitating the air flow and also to enable localised air outlet which can begin before the blade concerned has reached its oscillation point situated the farthest from the face against which it is fixed.

According to a variant of this embodiment, the blade-holder is made from a sufficiently thick plate to provide a sufficient height for the long bass blades to ensure the lateral and end tightnesses as described above, and chamfers, grooves or particular machinings are made at the level of the edges of the windows of the less bass blades to only reduce the thickness of the plate, which is initially identical over its whole surface, locally and specifically for each of the blades to a thickness in correlation with the dimension of the oscillation movements of the blade concerned.

According to another very important feature of a particular embodiment of the invention, certain vibrating tonal blades are at least fixed in totally reverse manner to the securing mode performed hitherto. The blown blades are therefore not fixed against the air inlet face of the blade-holder concerned but against the face of said blade-holder facing the side where the air exits after passing through the window in which the free part of said blades oscillates, which blades do however keep the concaveness of their camber at rest oriented in conventional manner, i.e. to the side via which the blown air enters said windows. In the same way, the sucked blades are not fixed against the air inlet face of the blade-holder concerned but against the air outlet face thereof, said blades keeping the concaveness of their camber at rest oriented in conventional manner, i.e. to the side via which the sucked air is inlet.

Such a reverse assembly presents the great advantage of enclosing the blade concerned in the thickness of the blade-holder, and the lateral and end faces of the window thereby already ensure very good lateral and end tightnesses on their own, while at the same time providing much larger outlet apertures, on the side and at the level of the free end of the blade, that open earlier than in the conventional assembly, which results in a sound that is very different from the sounds produced by the prior assembly.

According to another feature, the blades are not fixed against the air inlet wall or against the air outlet wall but against an intermediate bearing face positioned between the air inlet wall and the air outlet wall. This intermediate fixing face can easily be achieved by machining in the thickness of the blade-holder plate or by localised crushing of the blade-holder plate. This intermediate fixing position of the blade is very advantageous as the tightness means formed by the edges of the window are then positioned on each side of the mid-plane positioned between the two extreme oscillation positions of the blade.

According to a preferred embodiment, the above-mentioned intermediate fixing face can advantageously be positioned closer to the outlet face of the blade-holder than the inlet face of said blade-holder, in order to optimise the air-tightness on the inlet side while sufficiently deferring opening on outlet to compel the free part of said blade to fold to its maximum extent thereby generating a powerful sound.

According to a first embodiment, the harmonica according to the invention comprises two blade-holders as described in the foregoing, said blade-holder being arranged parallel to one another without however being automatically (compulsorily) parallel to the longitudinal mid-plane Px with which they can in fact on the contrary be arranged obliquely.

According to another embodiment, the harmonica according to the invention comprises at least two blade-holder plates at least one of which is arranged obliquely with respect to the longitudinal mid-plane Px of the harmonica advantageously with an angle of more than 5° (five degrees).

According to a preferred embodiment of the invention, the harmonica comprises at least a first blade-holder arranged obliquely with respect to the longitudinal mid-plane Px of the harmonica with an angle of more than 5° (five degrees) and at least a second blade-holder arranged obliquely with respect to the longitudinal mid-plane Px of the harmonica with an angle that is also more than 5° (five degrees), so that the planes passing through the respective bearing faces of said blade-holder against the reed comb form an open dihedron with an angle of more than 10° (ten degrees).

According to another feature of a preferred execution of this second embodiment, the harmonica according to the invention comprises two blade-holder plates on which all the blown vibrating tonal blades and all the sucked vibrating tonal blades of the instrument are mounted, one of these two blade-holder plates alone being able to support all the sucked blades whereas the second blade-holder plate alone supports all the blown blades only, or on the contrary each of the two blade-holder plates support both the blown blades and the sucked blades.

According to another feature of a particular embodiment, the respective angles of obliqueness of the two blade-holders with respect to the longitudinal mid-plane Px are not identical to one another so that the two blade-holder plates are therefore not arranged symmetrically on each side of said mid-plane Px.

According to another feature of a preferred embodiment, the two blade-holders are arranged symmetrically on each side of the longitudinal mid-plane Px of the harmonica so that the two planes passing through their respective bearing faces against the reed comb form an open dihedron between them that is open either on the mouthpiece side or on the resonator side of the instrument.

According to another particular embodiment, the harmonica according to the invention comprises a single blade-holder on which all the sucked and blown vibrating tonal blades of the instrument are mounted.

This single blade-holder can be positioned parallel with the longitudinal mid-plane Px, or on the contrary obliquely with respect to the plane Px or even be arranged perpendicularly to the plane Px at least in the vertical plane if not in both the vertical and horizontal planes.

According to a preferred embodiment of this version comprising a single blade-holder, the plane passing through one of the two large faces of the single blade-holder constitutes with the longitudinal mid-plane Px a dihedron whose opening angle is more than 5° (five degrees) preferably more than 20° (twenty degrees) and in particular more than 40° (forty degrees). According to a privileged embodiment, said angle is comprised between 75° (seventy-five degrees) and 90° (ninety degrees).

It should be specified that the oblique arrangement of the blade-holder with respect to the longitudinal mid-plane Px as described hereabove results in an optimised air flow which, by ensuring a better aerodynamic efficiency, thereby makes it possible to envisage tonal vibration of thicker and therefore more solid blades emitting a more powerful sound than the blades of harmonicas of the prior art in which the air flow undergoes sharp changes of direction at right angles which slow it down and considerably reduce its ability to make the blades flex to make them vibrate.

According to another feature of this embodiment in which all the sucked and blown blades are arranged on the same blade-holder, the sucked blades are arranged in a row located nearer the mouthpiece of the instrument than the second row formed by the blown blades. According to a particular feature of this embodiment, a mouthpiece hole supplies an air channel, which air channel supplies a sucked blade and a blown blade, the longitudinal axes of each of these two blades being advantageously aligned in the continuation of one another. The two tonal blades can be arranged in the same direction or more advantageously in the opposite direction in such a way that they can be fixed by one or more common rivets sandwiching the blade-holder between the fixed part of the sucked blade and the fixed part of the blown blade.

According to an important feature of a preferred embodiment of all the versions of harmonicas according to the invention described in the present document, the rear face comprising the mouthpiece holes of the instrument and the parts of the main body on which the musician's mouth is applied and moves in the longitudinal direction of the instrument when he plays, and which are constituted by the mouthpiece face, form a monolithic assembly with the reed comb formed by the walls separating the air flow channels opening out into the mouthpiece holes. Such an arrangement guarantees total airtightness between these different components in comparison with harmonicas of the prior art.

According to another important feature of a preferred embodiment, the harmonica according to the invention comprises a wind chest forming a monolithic assembly with the mouthpiece, to which assembly a single top or bottom cover is secured by screws or other removable securing means, if the instrument only comprises a single blade-holder, or two covers, top and bottom, if the instrument comprises two blade-holders.

Each of the above-mentioned covers advantageously comprises walls arranged as reinforcing ribs on the inside face thereof with which it constitutes a monolithic assembly designated in the present document under the term counter wind chest. The reinforcing ribs are formed by material blades arranged substantially vertically with respect to the longitudinal mid-plane Px, the vertical mid-plane of at least some of these ribs being advantageously coplanar with the vertical mid-plane of the corresponding separating wall of the wind chest situated facing said rib in such a way that the blade-holder plate is thus sandwiched between these two material blades that are very solid as they are both arranged edgewise. The wind chest and counter wind chest are pressed in the direction of one another by clamping means, such as screws in particular, the axis whereof is advantageously arranged substantially perpendicularly to the surface of the blade-holder concerned.

According to another feature, tapped holes are arranged in the counter reed comb and/or in the main body for fixing a mike and/or to be able to fix the harmonica on a support for it to be able to be used without being held by hand, for example when the musician plays the guitar at the same time.

According to another feature, the harmonica equipped with at least one blade-holder according to the invention is of the tremolo or octave diatonic type each mouthpiece hole of which supplies either with a single tonal vibrating blade or with two tonal vibrating blades of the same type, which are therefore either blown or sucked and which are generally tuned with respect to one another either with a slight stagger to produce a tremolo effect or tuned one octave apart.

According to another feature of a particular embodiment, each of the mouthpiece holes of the instrument is in relation with at least three tonal vibrating blades, and ideally four tonal vibrating blades, which are either all supplied by a single common air flow channel or supplied two by two by two air flow channels or each supplied by an individual air flow channel.

According to a first embodiment of this version of a harmonica each of the mouthpiece holes of which supplies three tonal vibrating blades, said three blades are all of the same type and therefore all three are either sucked blades or blown blades, the blades of two adjacent holes being on the other hand systematically of opposite type: one mouthpiece hole being related to three blown blades whereas each of the two mouthpiece holes situated on each side of the previous hole is related to three sucked blades or vice-versa, so that one mouthpiece hole out of two supplies three tonal blades called blown blades and one mouthpiece hole out of two supplies three tonal blades called sucked blades. These three tonal blades supplied by the same mouthpiece hole are tuned to one another in unison, in harmonics and/or with a slight stagger between them to generate a tremolo effect.

According to another embodiment of the harmonica each mouthpiece hole of which is related to three vibrating tonal blades, two of these three tonal blades are both of blown type or sucked type whereas the third is of the opposite type to the other two and therefore respectively of sucked type or blown type, two adjacent holes on the other hand being systematically of opposite type: one mouthpiece hole being related to two blown blades and one sucked blade whereas each of the two mouthpiece holes situated on each side of the previous hole is related to two sucked blades and one blown blade. According to this particular embodiment, all the blades of the harmonica supported by the blade-holder or holders positioned on one side of the longitudinal mid-plane Px are of the same type, either sucked or blown, and all the blades support by the blade-holder or holders positioned on the other side of said plane Px are of the opposite type, therefore respectively blown or sucked.

According to another embodiment method the aim of which is to obtain optimised results in terms of sound restitution, at least some of the elements constituting the harmonica according to the invention are manufactured by injecting a thermoplastic material and are then covered by a thin metal film by electroplating or by vacuum metallisation or by means of any other suitable process.

According to one feature, the vibrating blades are fitted either on the blade-holder or directly on the reed comb or wind chest.

According to a particular embodiment, the wind chest or reed comb of the instrument is composed of two half reed combs assembled together in the longitudinal direction of the instrument to form the reed comb and the blades are fitted directly on these half reed combs so that these half reed combs therefore both act as blade-holders.

According to another feature of a particular embodiment, the blade-holder, reed comb or above-mentioned half reed combs are manufactured by moulding aluminium alloys or made from thermoplastic or thermosetting material whereas the blades are made from metal.

Means arranged in the blade-holder, or if this is the case, in the wind chest, perform fixing of the fixed part of the blade concerned in the exact position required for satisfactory operation of the vibrating free part of said blade.

These fixing means are formed on the one hand by means for precise guiding of the fixed part of the blade in translation in the direction of its longitudinal axis which ensures that the longitudinal axis of said blade is coplanar with the longitudinal axis of the window concerned, and on the other hand by means for immobilising the blade in translation which ensure that said blade is positioned precisely and held in the required position for its free end to be located at the right distance from the end of the window concerned.

According to another feature, the free end of at least some of the vibrating tonal blades can be of angular shape as are the blades of the prior art, but it can also very advantageously be rounded with a radius equal to the half-width of the blade concerned or be rounded with a radius of larger value or on the contrary of smaller value than the width of the blade. The shape and dimensions of the corresponding opening, or window, arranged in the blade-holder and through which this blade passes when it vibrates are naturally adjusted according to the shape and dimensions of the blade concerned.

According to another feature, to prevent the blades from pivoting in undesired manner around their single fixing rivet, the end of the tonal blades via which the latter are secured to the blade-holder comprises either one or two sides that are straight or of any other shape and that press with precision against a rim of complementary shape made in said blade-holder.

According to another feature of a preferred embodiment, for the instrument to be able to be held comfortably while ensuring a good diffusion of the bass notes through a sufficiently open resonator, the distance separating the mouthpiece face from the extreme front edge of the resonator at the level of the bass notes is larger than the distance separating the mouthpiece face from the extreme front edge of the resonator at the level of the treble notes.

Other advantages and features will become more clearly apparent from the following description of different embodiments of the invention given for non-restrictive example purposes only and represented in the accompanying drawings, in which.

Views 11 to 14 show a particular blade-holder supporting the 10 blown blades of a harmonica, said blade-holder being achieved by stacking plates of different lengths.

Views 15 to 18 show a particular blade-holder supporting the 10 sucked blades of a harmonica, said blade-holder being achieved by stacking plates of different lengths in the same way as the blade-holder presented in FIGS. 11 to 14 with which it constitutes an assembly for equipping a harmonica according to the invention.

Views 19 to 28 show another embodiment of a blade-holder according to the invention for a harmonica to be equipped with two blade-holders, each of the two blade-holders presented in these figures being made from a single plate comprising zones of different thicknesses.

Views 34, 35, 36 show another embodiment of a harmonica equipped with two blade-holders according to the invention the vibrating tonal blades of which are fixed against the face of said blade-holder oriented to the air outlet side.

FIGS. 37 to 52 show an embodiment of a harmonica equipped with a single blade-holder supporting both the blown blades and the sucked blades. Among these views:

FIGS. 37 to 41 show the blade-holder made from a single plate comprising zones of different thicknesses.

FIGS. 42 to 47 are cross-sectional views showing different details of manufacture and operation.

Figure 49:
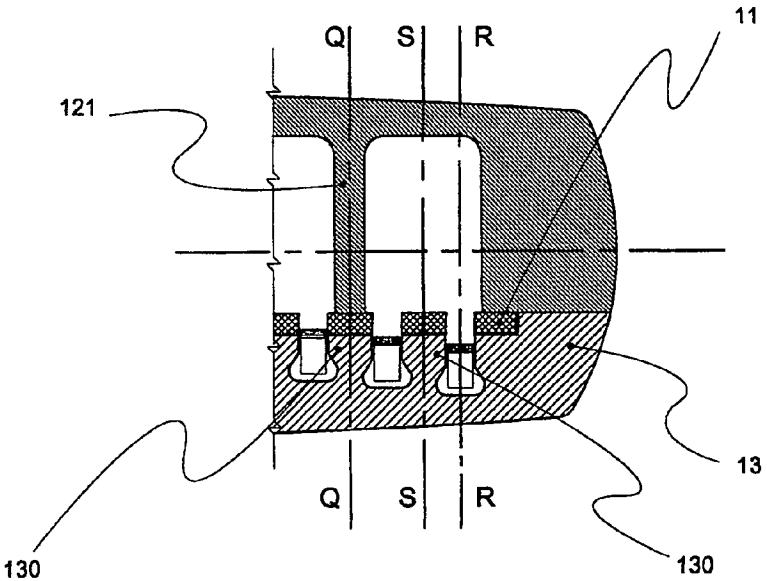
Figure 48:
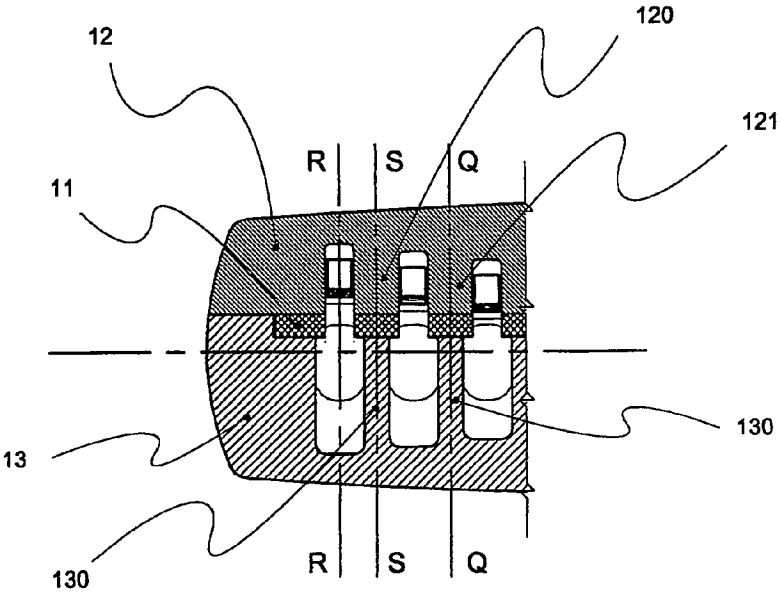

FIGS. 48 and 49 are two partial longitudinal cross-sections.

Figure 50:
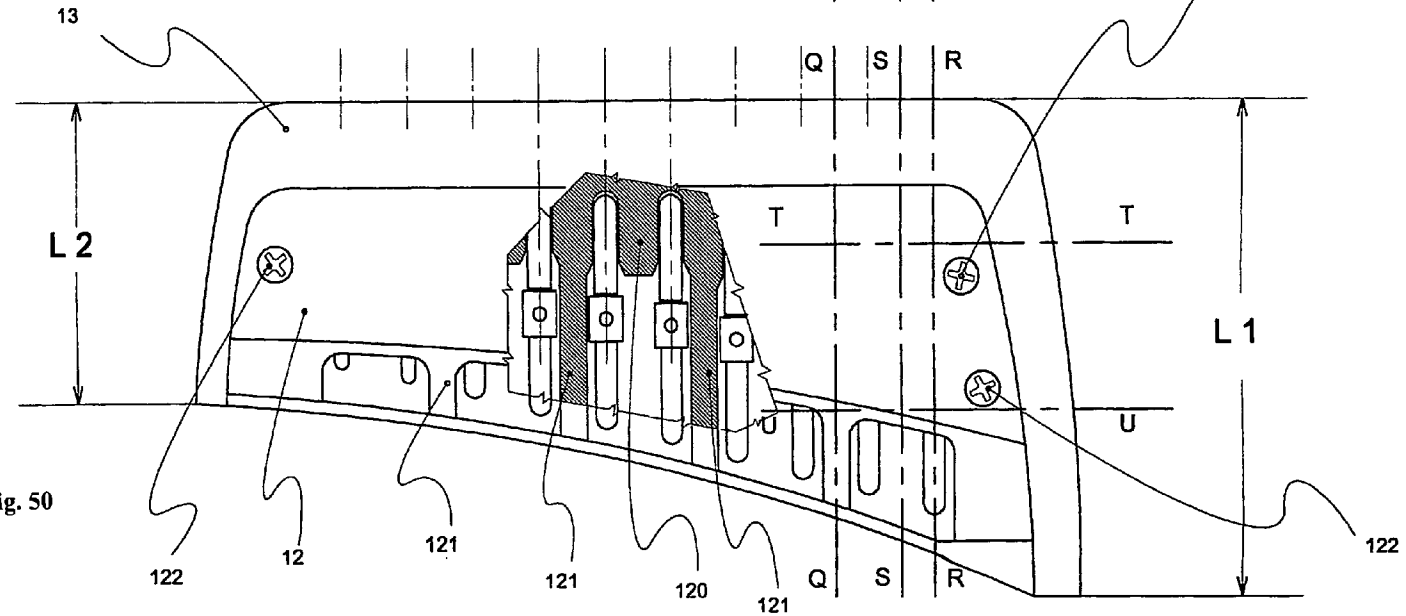

FIG. 50 is a top view with partial cutaway showing the internal design of the harmonica.

Figure 51:
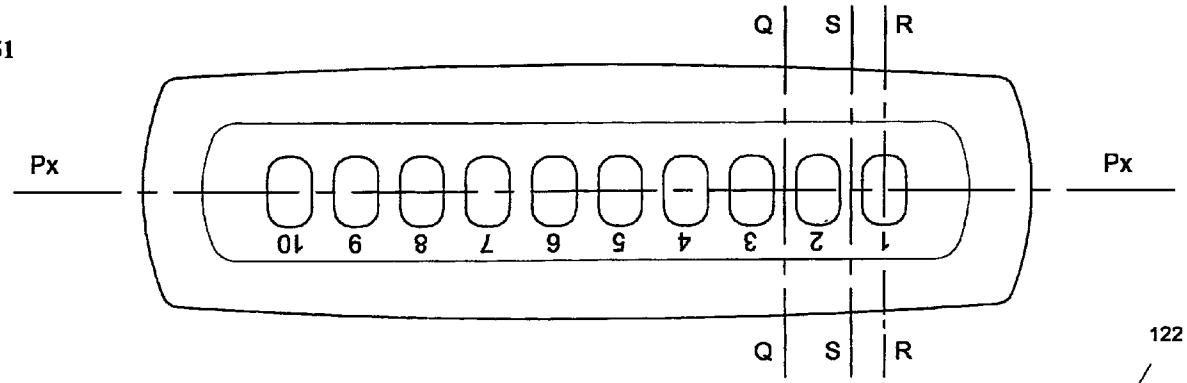

FIG. 51 shows the harmonica seen from the mouthpiece side of the instrument.

Figure 52:
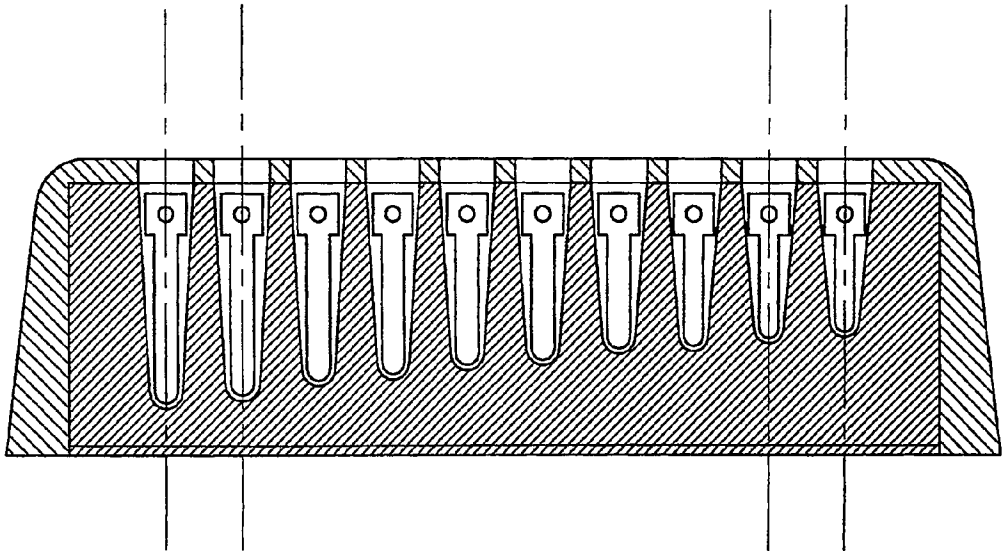

FIG. 52 is a cross-section along the mid-plane Px showing a particular arrangement of air channels of a harmonica according to the invention.

Figure 53:
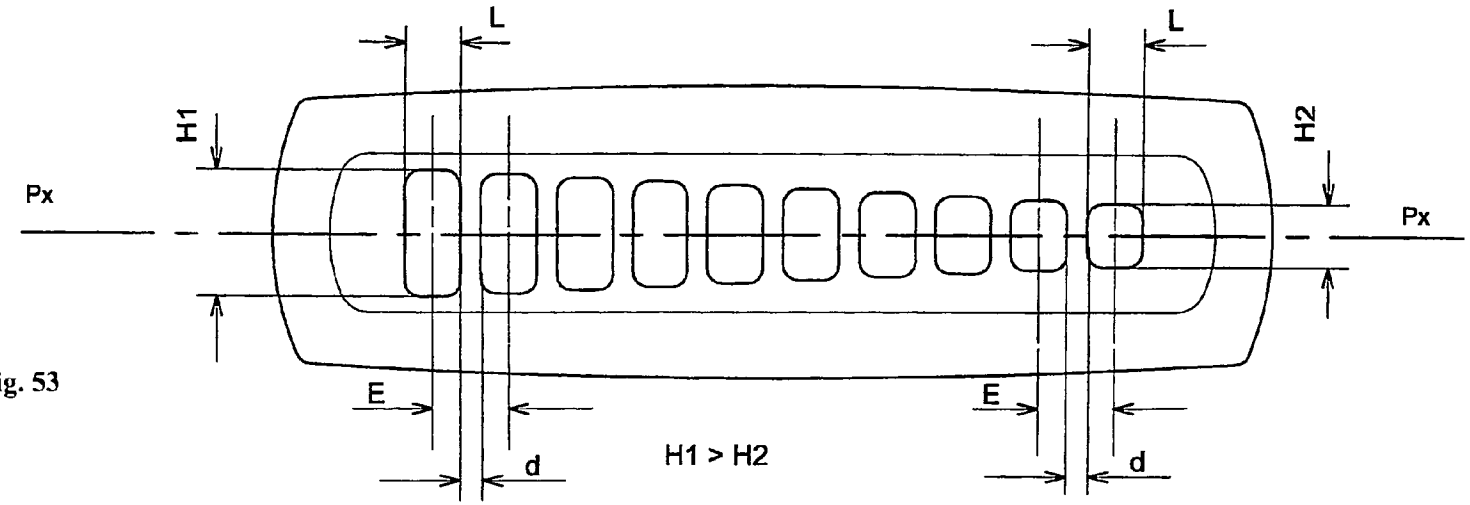
Figure 54:
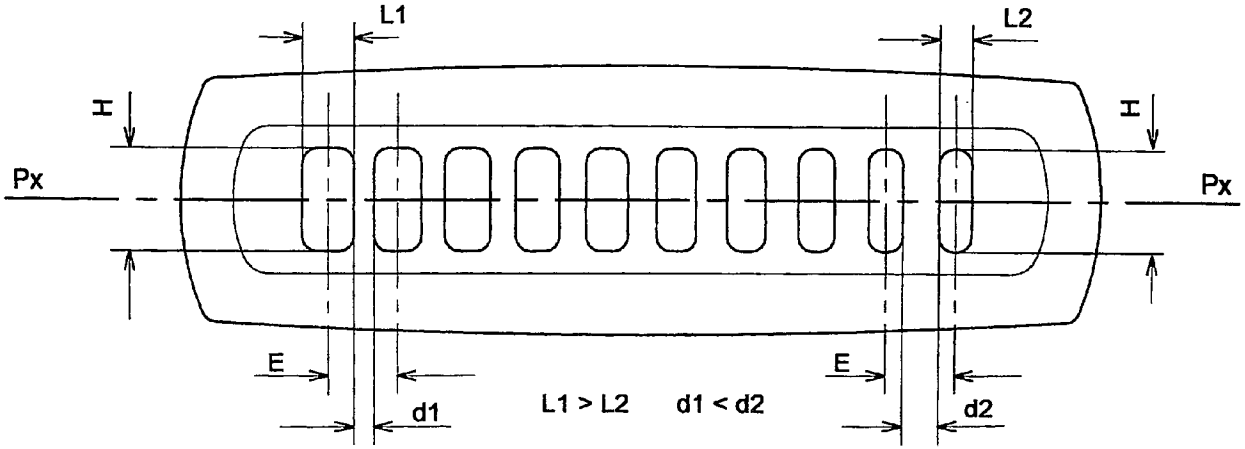

FIGS. 53 and 54 are views showing the rear face of the instrument, therefore the mouthpiece face of the instrument, in which the air channel inlet holes are arranged.

Figure 57:
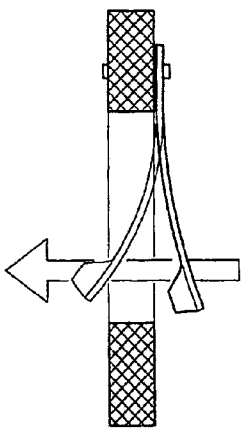
Figure 56:
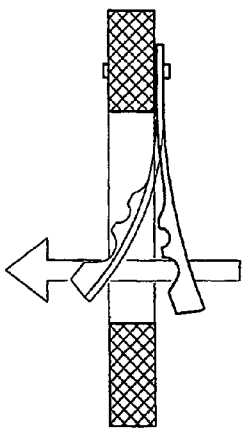
Figure 55:
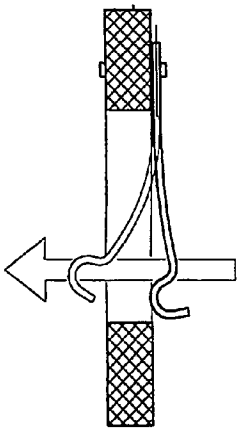

FIGS. 55 to 57 are cross-sectional views along the longitudinal axis of an air channel, showing different embodiments of the tonal blades, in particular of the long and therefore bass blades.

FIGS. 58 to 62 are top views showing all or part of the tonal blades and of the corresponding zone of the blade-holder supporting the latter these views presenting different particular embodiments of tonal blades designed to enable localised controlled air leaks at the level of the end zones of said blades.

Figures 59, 60, 61, 62, 63, 64, 65:
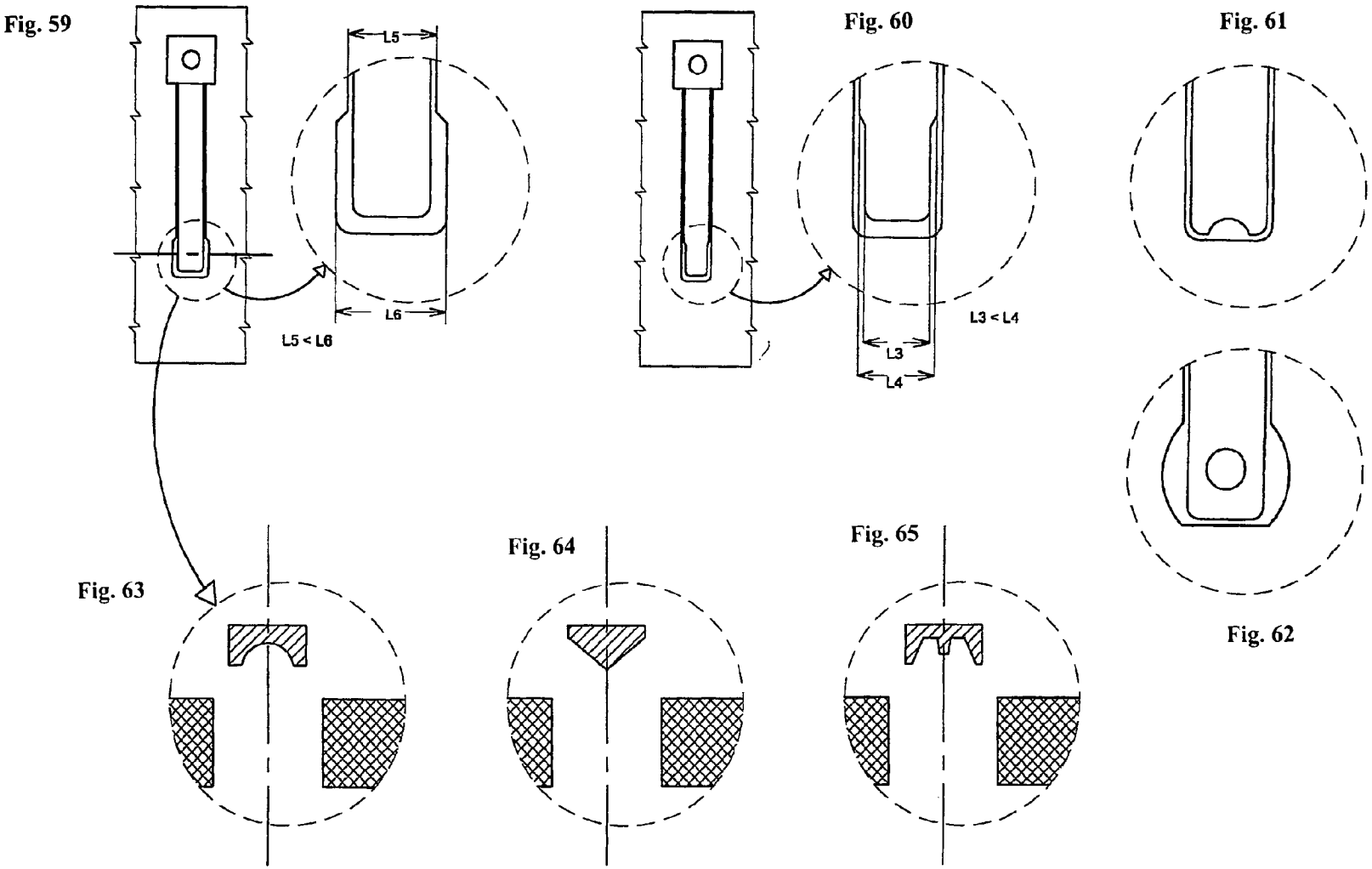

FIGS. 63 to 65 are cross-sectional views of ends of tonal blades made along a plane substantially perpendicular to the longitudinal axis of said blades.

FIGS. 66 to 69 represent a first particular embodiment according to the invention of a tonal blade and of the part of the blade-holder associated therewith.

FIGS. 70 to 73 represent a second particular embodiment according to the invention of a tonal blade and of the part of the blade-holder associated therewith.

Figure 78:
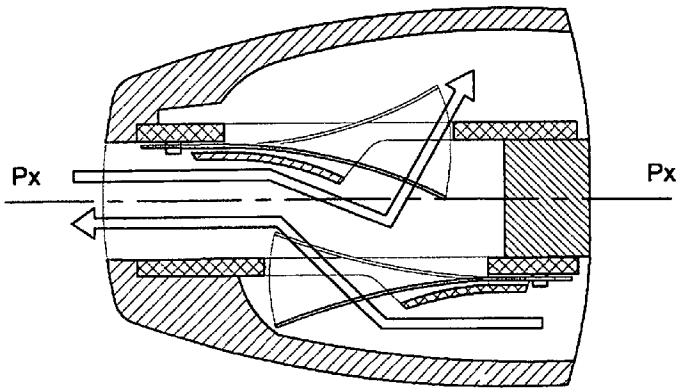

FIGS. 74 to 78 show a third particular embodiment according to the invention of two tonal blades and of the part of the blade-holder associated therewith, and FIG. 78 is a cross-sectional view of a harmonica equipped with two blade-holders as represented in FIGS. 74 to 77.

FIGS. 79 to 82 show yet another embodiment of a blade-holder according to the invention.

Prior to the explanations which follow, it is important to specify that to make the drawings more legible and more explicit, the thickness of the blade-holder plates has been deliberately greatly increased in comparison with their actual thickness and that the same is the case for the vibrating tonal blades represented much thicker in these drawings than they actually are. Likewise, the lateral clearance between the lateral edges of the tonal blade and the corresponding edges of the window through which it oscillates, and also the clearance between the end of said blade and the corresponding edge of said window which are in reality about 1/10th of a millimeter, have here been greatly increased for ease of understanding of the drawing.

In views 1 to 8, the harmonica 1 is formed by a peripheral shell 100 in the form of a bell open on the resonator side of the instrument and comprising holes on the opposite face constituting the mouthpiece face of the instrument via which the harmonica player sucks or blows the air making the vibrating tonal blades vibrate by means of air flow channels. The harmonica represented in these different figures is of the type conventionally referred to as "ten-hole" because it comprises ten mouthpiece holes numbered here from 101 to 110 with reference to the FIGS. 1 to 10 generally engraved on the mouthpiece face of these instruments, hole 1 corresponding to the most bass note of the instrument and hole 10 to the most treble note.

Inside the main body 100, the reed comb or wind chest 2 comprises a plurality of walls 20 arranged perpendicularly to the plane Px separating the different air flow channels numbered from 201 to 210 in correlation with the corresponding mouthpiece holes.

Two blade-holders according to the invention, 3 and 4, arranged horizontally and parallel to the longitudinal mid-plane Px of the instrument, are kept flat by clamping means against the corresponding faces of wind chest 20 which they sandwich. Blade-holder 3 arranged above wind chest 2 supports the vibrating tonal blades called blown blades, numbered from 301 to 310 in correlation with the numbers 1 to 10 on the mouthpiece facing each of the corresponding air channels.

The bottom blade-holder 4, situated under wind chest 2, supports the vibrating tonal blades called sucked blades, numbered 401 to 410 in correlation with the numbers 1 to 10 on the mouthpiece facing each of the corresponding air channels.

The blown tonal blades 301 to 310 are fixed in conventional manner against the bottom face of the top blade-holder 3 therefore corresponding to the sucked air inlet face which corresponds to the normal vocation of this blade-holder, whereas the sucked tonal blades 401 to 410 are fixed also in conventional manner against the bottom face of the bottom blade-holder 4, which also corresponds to the blown air inlet face which corresponds to the normal vocation of this blade-holder 4.

Each of the tonal blades is positioned facing a window of suitable dimensions arranged in the blade-holder concerned through which it can oscillate when it is animated by an air flow to generate a sound.

Figures 1, 2, 3:
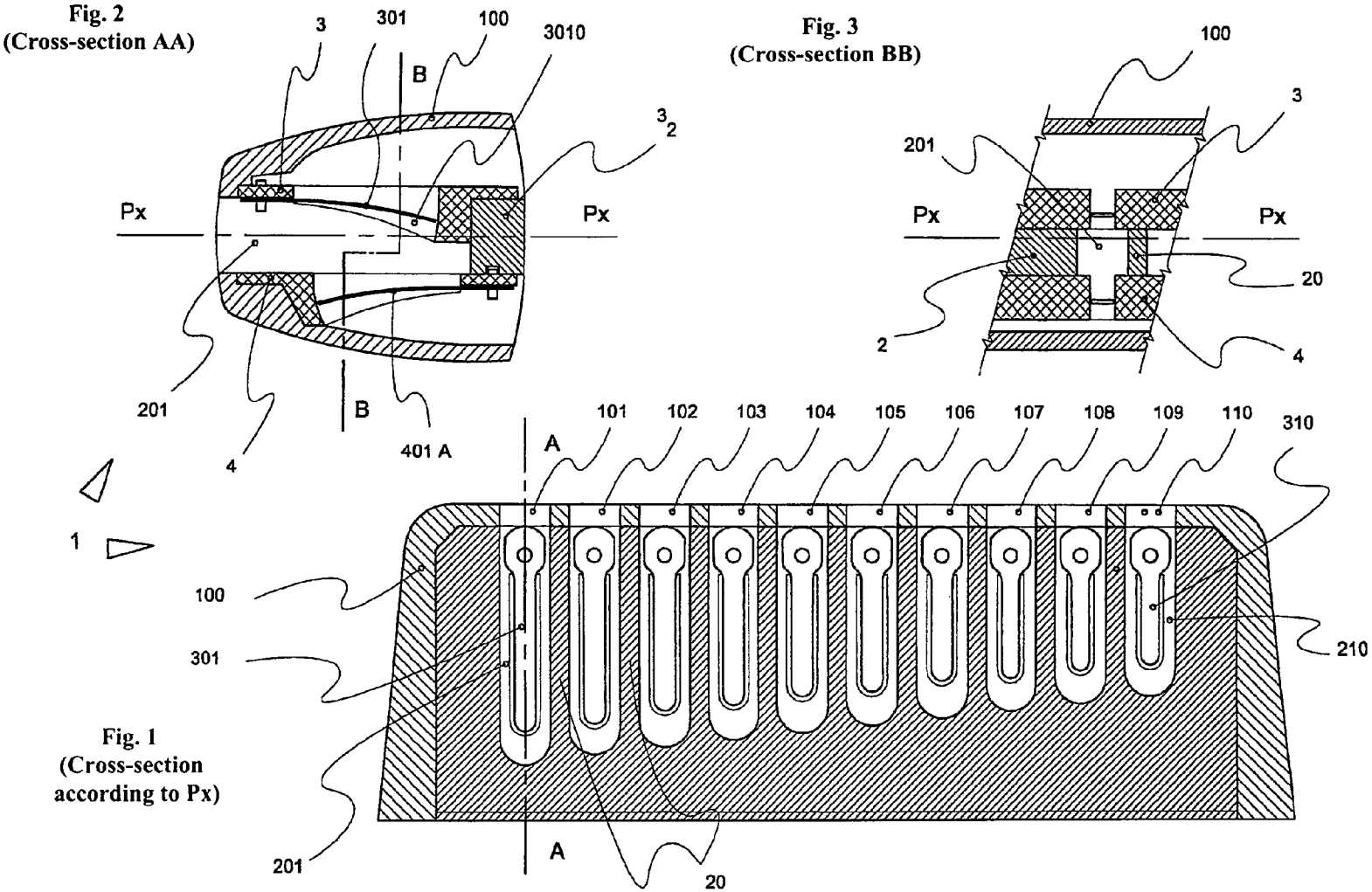
FIGS. 1 to 5 show a first embodiment of a harmonica equipped with a blade-holder according to the invention manufactured from a single plate machined in its thickness.

The corners of the free end of the tonal blades are advantageously either chamfered or grooved or, as shown here in FIG. 1, rounded with a radius substantially equal to half the width of the blade for the purposes of both improving the life-span of the cutting tools used to produce these blades and of ensuring a more fluid air flow at the level of the ends of the blades. The corners of the fixed end of the tonal blades via which the latter are fixed against the blade-holder are also advantageously grooved as shown in FIG. 1, as are the re-entrant corners positioned at the level of the joining zone between the fixed part and the oscillating part of the tonal blades where the acute re-entrant corners of the tonal blades of the prior art often constitute a source of breaking by concentration of the bending stresses.

According to an important feature of the invention, at least in a part if not advantageously in the whole of the zone swept by the free part of the tonal blade when it oscillates, the lateral faces and the end face of the window through which said blade 301 or 401 oscillates is extended by walls respectively 301 L, 301 E and 401L, 401 E which extend on the air inlet side of said blade-holders beyond the planes, respectively P3 and P4, passing through the fixing faces of said tonal blades 301 and 401.

As these figures show, blade-holders 3 and 4 are made from plates shaped in such a way that, for each of them, the face against which a tonal blade is fixed is positioned between the air outlet face and the air inlet face of said blade-holder.

In other words, the distance comprised between the bearing face against which the tonal blade is fixed and the face of the blade-holder situated on the air outlet side is smaller than the distance comprised between said outlet face of the blade-holder and the extreme point of the blade-holder on the inlet face side of the latter.

Or to explain in yet another way, the thickness of the blade-holder is larger at the level of the free end of the vibrating tonal blade than it is at the level of the fixing zone of said blade against said blade-holder.

FIG. 2 shows the characteristic positions of blown tonal blade 301 and of sucked tonal blade 401 at rest.

Figure 4:
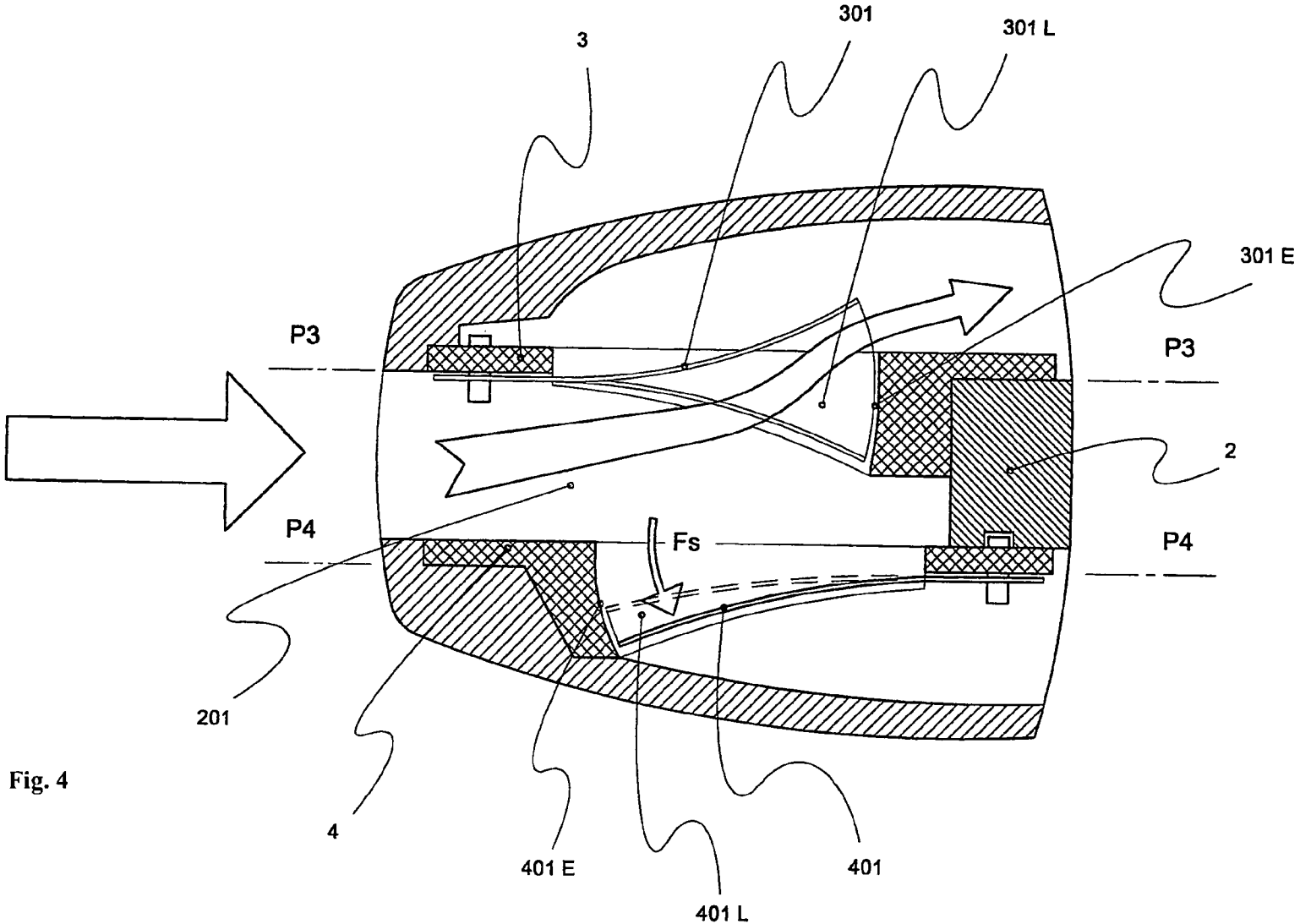

FIG. 4 shows the advantage of the proposed arrangements when the harmonica player blows air into the instrument. The air pressure then increases very quickly inside channel 201 exerting a thrust against sucked blade 401 but rather in localised manner in its part close to its fixing point where it is therefore not very flexible, which results in a small outward movement of the free part of said sucked blade 401 in the direction FS, which blade does not extend beyond the extreme edges of the continuations of the tightness walls which thereby continue to efficiently oppose nuisance air leaks, and the air thrust is moreover exerted on the free, therefore flexible, part of blown tonal blade 301 which flexes greatly and immediately passes beyond the top face, i.e. the air outlet face of the blade-holder 3 enabling the air to escape quickly. This air outlet causes a sharp drop of the pressure prevailing inside channel 201 enabling the two tonal blades 301 and 401 to return immediately to their initial positions. Blown tonal blade 301 again closing the outlet window causes the air pressure inside channel 201 to increase which triggers a new cycle identical to the previous one thereby generating tonal vibrations following the oscillations of said blade 301 between its two extreme positions represented in thin lines in FIG. 4.

Figure 5:
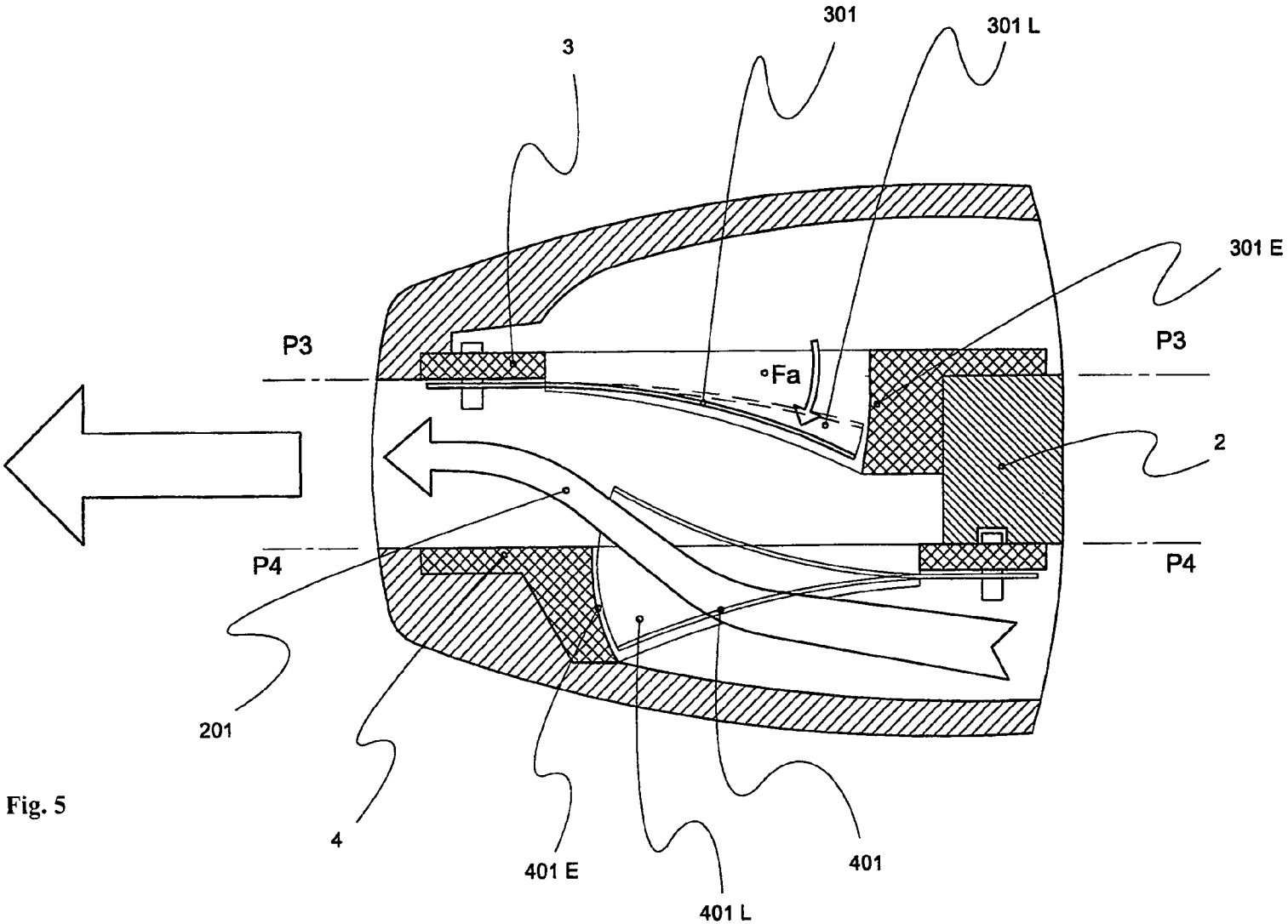

FIG. 5 shows how the instrument according to the invention functions when sucking makes the corresponding tonal blade 401 vibrate with a sequence of actions quite identical to that of blowing described in the foregoing, the negative pressure inside channel 201 on the other hand resulting in a thrust tending to flex blown tonal blade 301 inwards in the direction of Fa.

Figure 6:
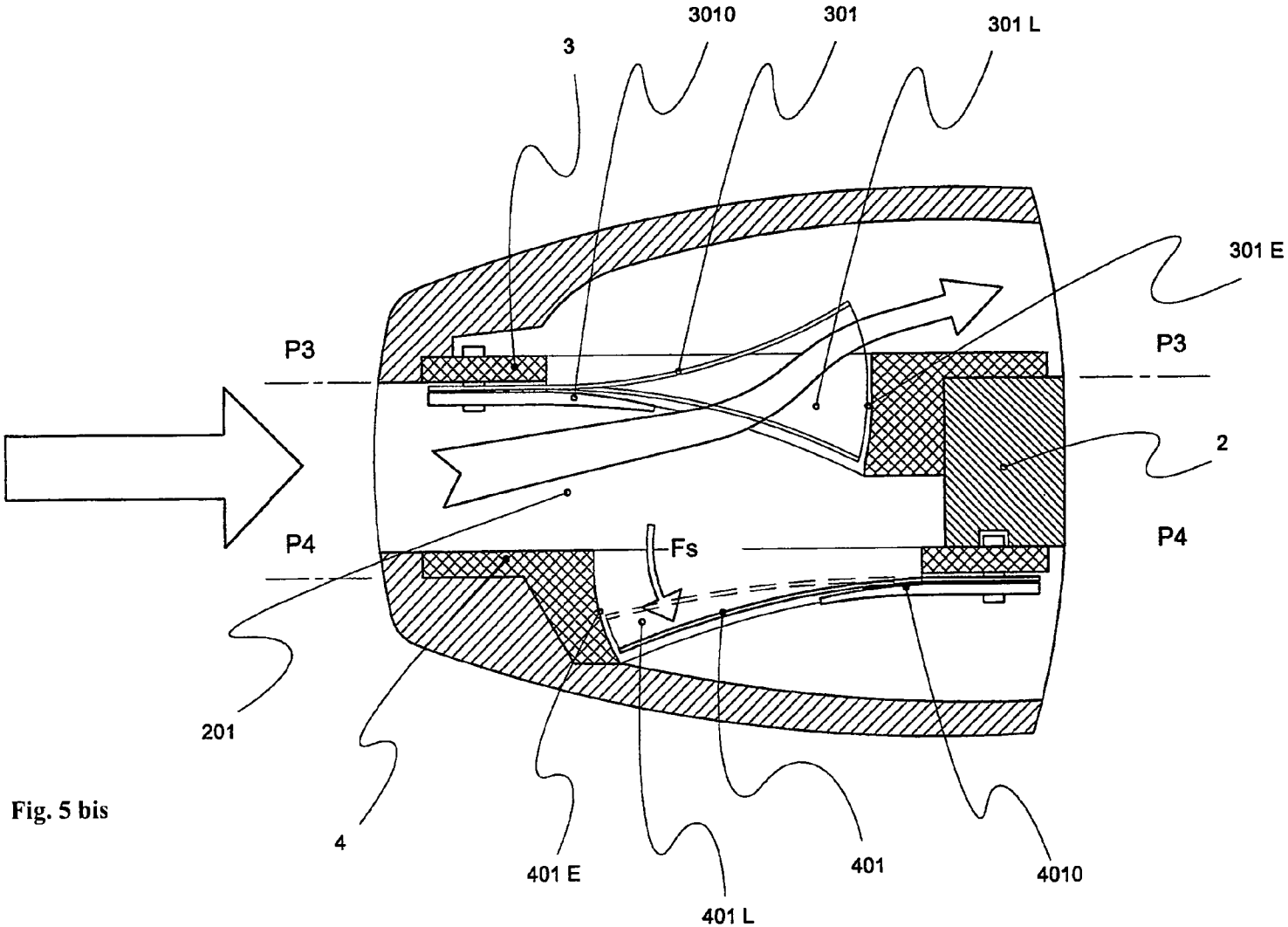
FIGS. 6 to 8 show a particular arrangement of certain zones of the blade-holders presented in the previous figures.

FIG. 5*bis* shows an alternative embodiment of the harmonica presented in FIGS. 5 and 6. In this FIG. 5*bis*, blade-holders 3 and 4 comprise counter-blades 3010 and 4010 acts as stops in flexion for the corresponding tonal blades respectively 301 and 401. Thus, as shown by FIG. 5*bis*, when sucked blade 401 is pushed outwards by the high air pressure prevailing in channel 201, it comes up against the stop formed by counter-blade 4010 to prevent its free end from being pushed beyond the extreme ends of tightness walls 401L and 401 E and to thereby enable it to play its role of air-tight cut-off valve. The operating principle is identical for counter-blade 3010 when sucked blade 401 is involved generating a negative pressure in channel 201 tending to flex inwards in the direction of blown blade 301.

The cambers of counter-blades 3010 and 4010 are naturally sufficiently pronounced for the corresponding blades, respectively 301 and 401, not to come into contact with the latter during their normal vibrations. These counter-blades could furthermore advantageously be made from plastic and/or from another material presenting a soft and non-noisy contact to prevent any nuisance noise.

Figure 7:
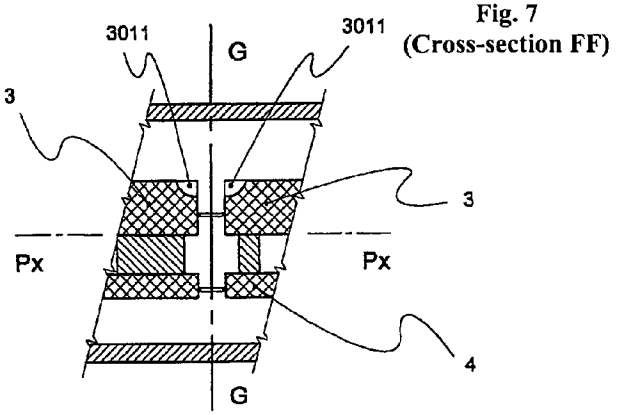
Figure 6:
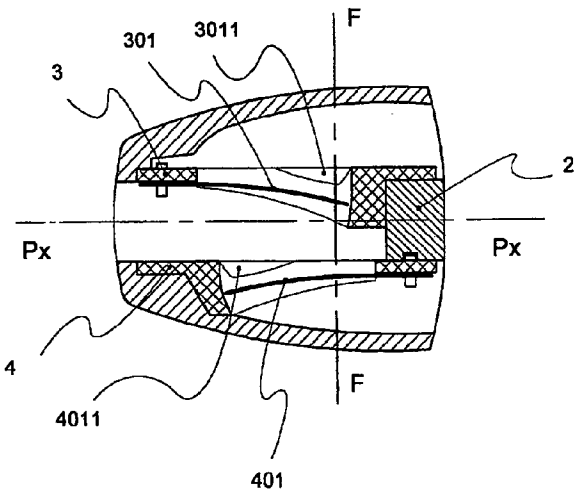
Figure 8:
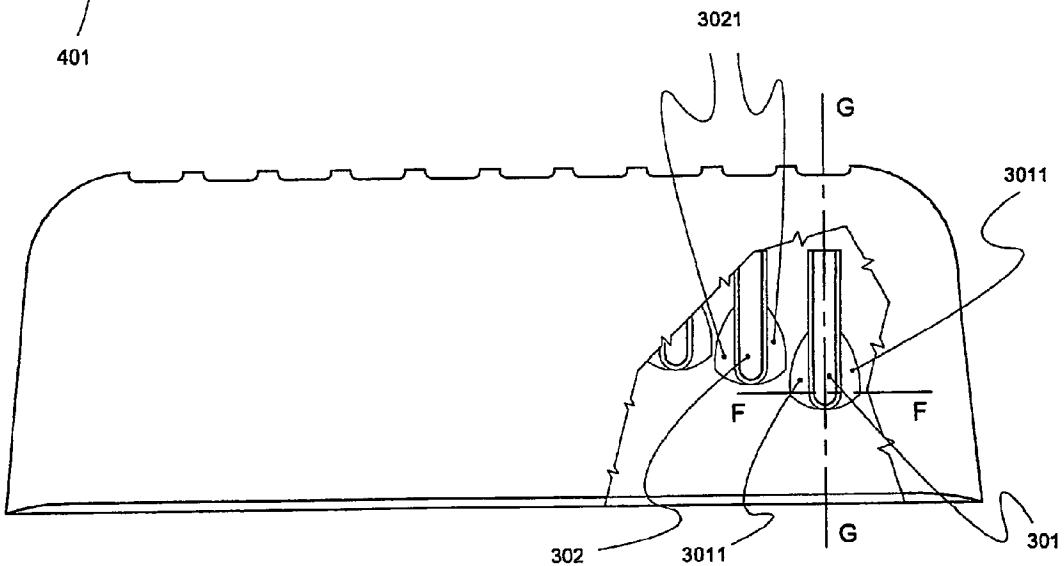

FIGS. 6, 7 and 8 show an alternative embodiment in which the windows through which the vibrating tonal blades oscillate comprise arrangements in the form of curved fillets 3011, 3021, 4011, on their lateral edges situated on the air outlet side of said blade-holders 3 and 4, designed to enable progressive outlet of the air and a channeled flux on each side of the free end of the vibrating tonal blade concerned to absorb its return movements better to obtain more velvety, more dampened sounds, which are interesting for certain types of music.

Figure 10:
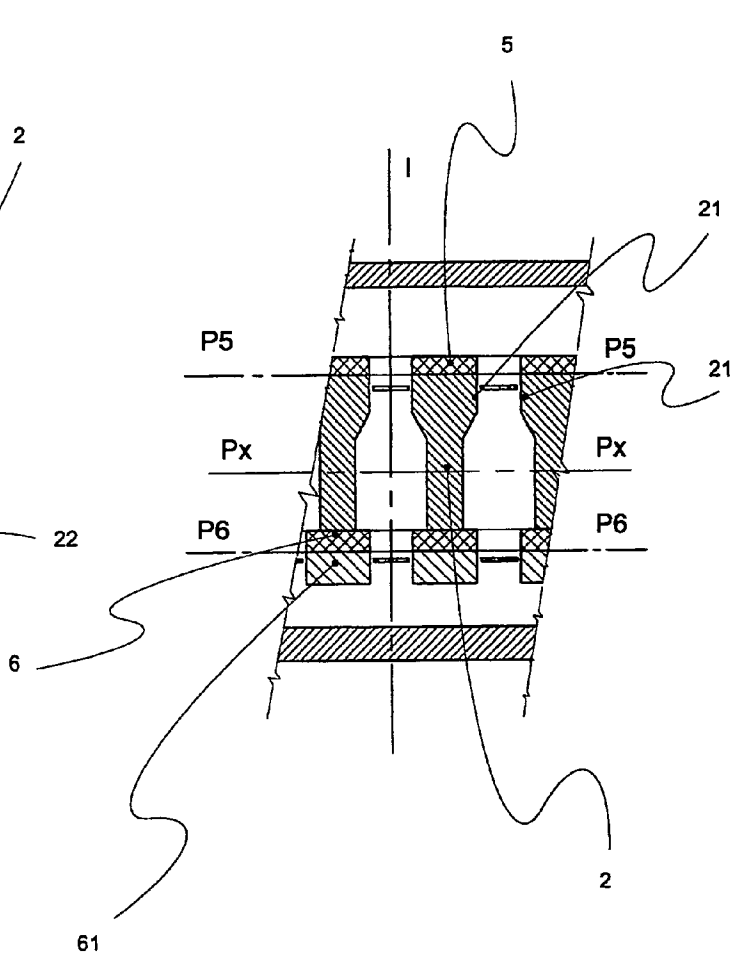
FIGS. 9 and 10 show a second embodiment of a harmonica according to the invention in which the blade-holders according to the invention are achieved by stacking several plates pressed against one another.
Figure 9:
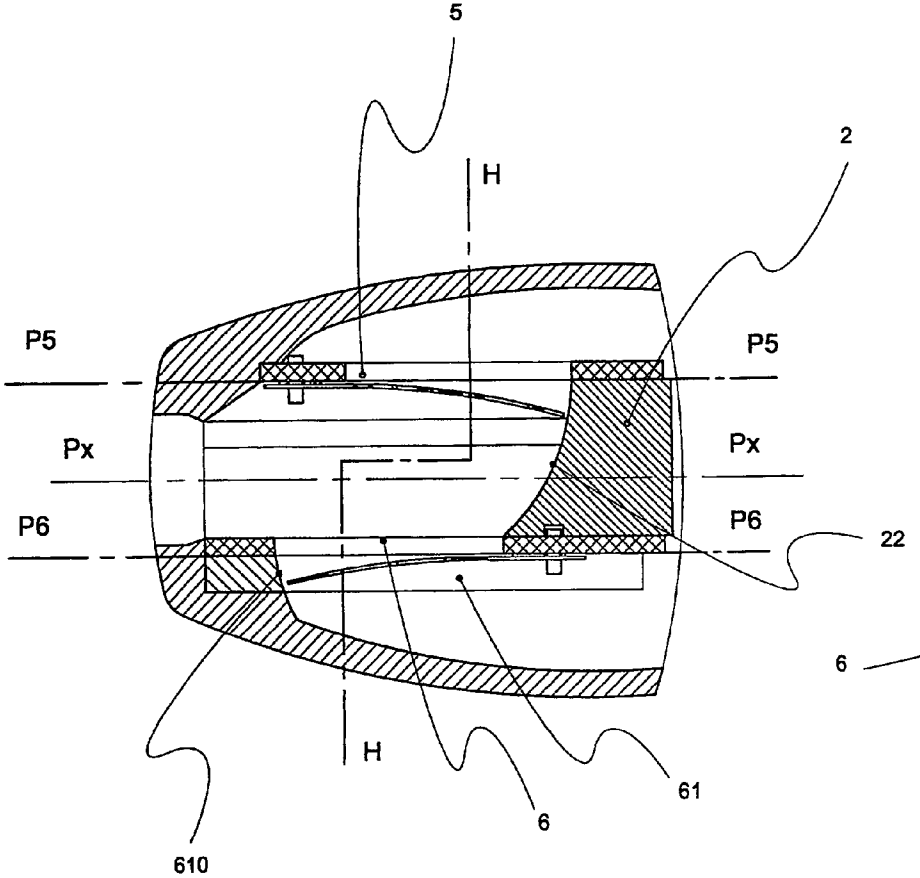
Figures 15, 16, 17, 18:
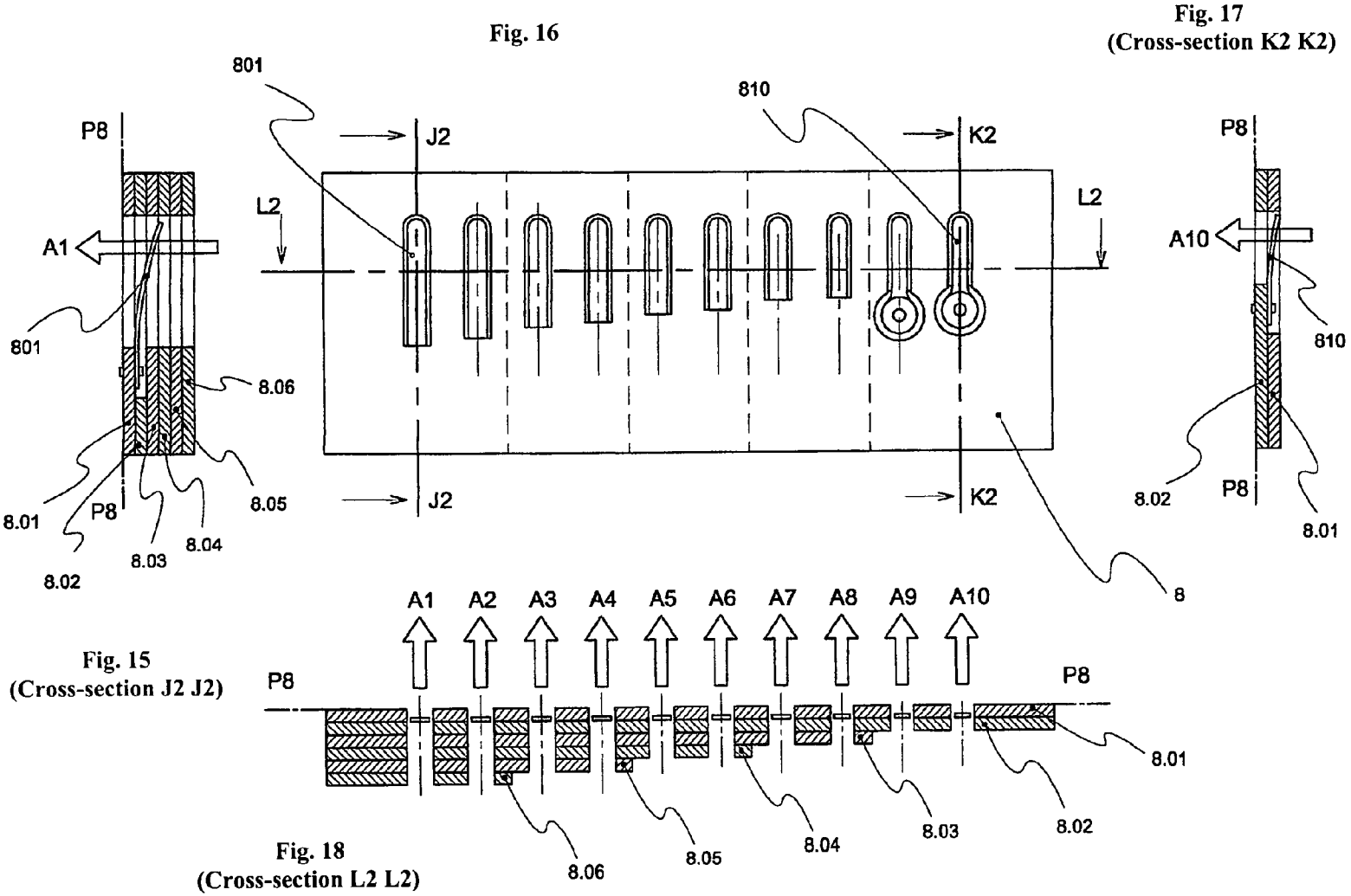
Figure 24:
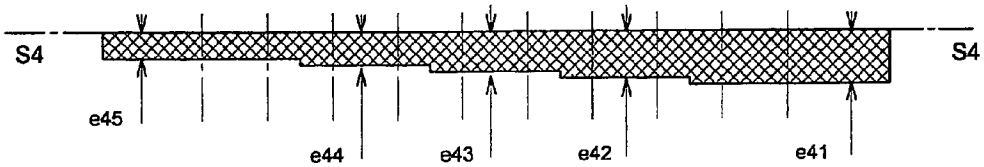
Figure 26:
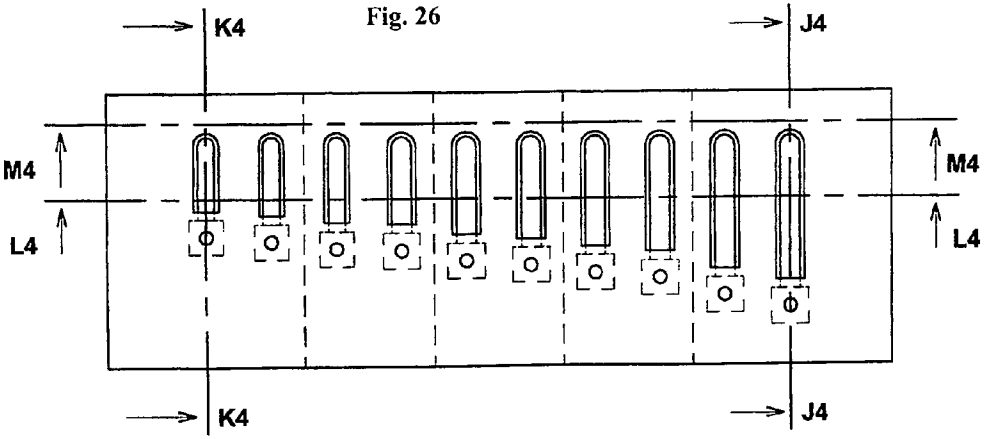
Figure 27:
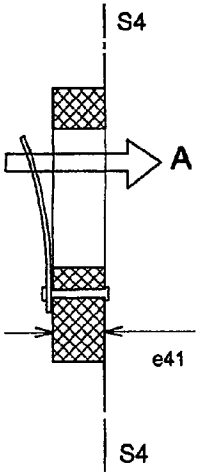
Figure 25:
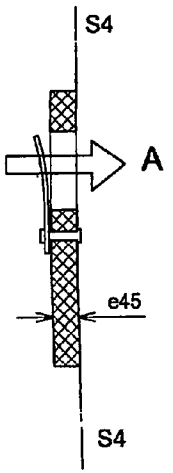
Figure 28:
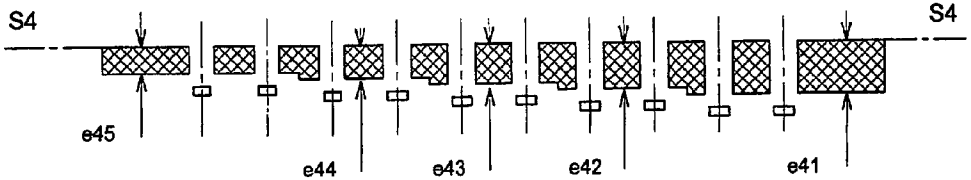
Figure 29:
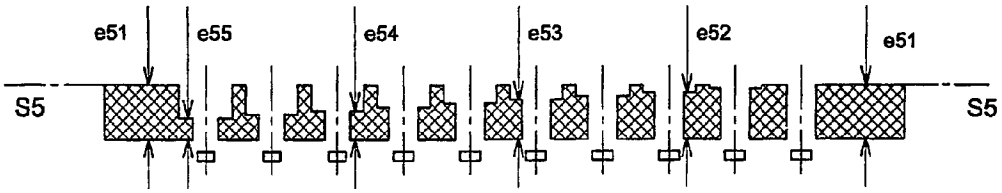
Figure 32:
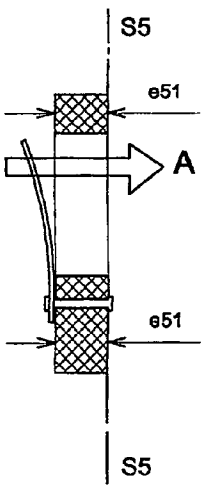
Figure 31:
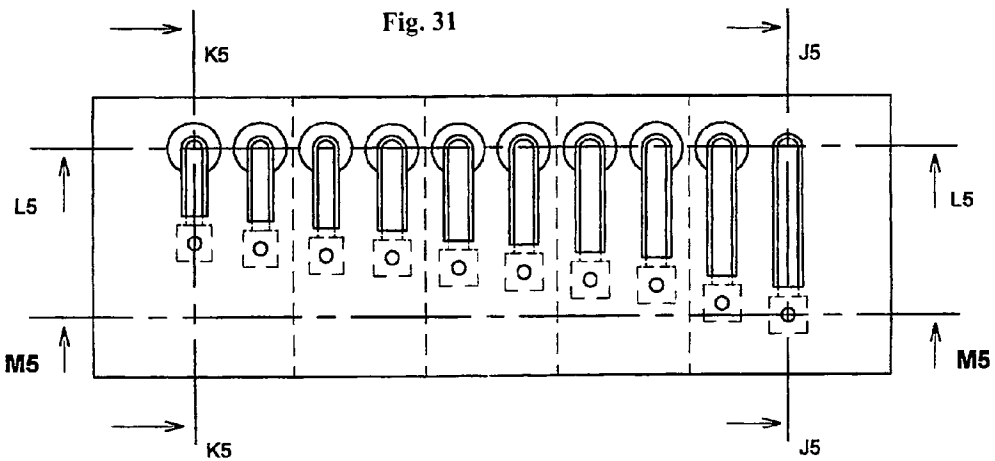
Figure 33:
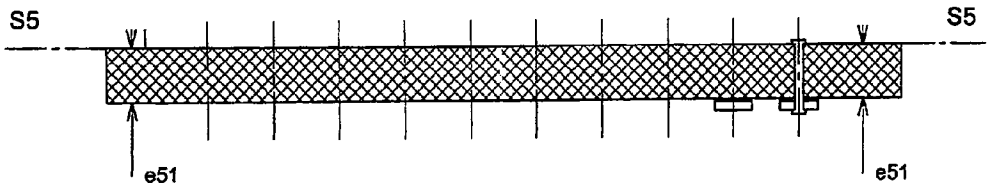
Figure 30:
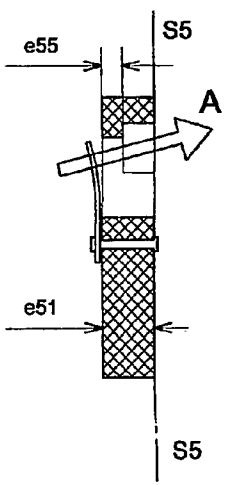

FIGS. 9 and 10 show another embodiment of a harmonica according to the invention comprising a top blade-holder 5 supporting blown blades 50 and a bottom blade-holder 6 supporting sucked blades 60 sandwiching wind chest 2.

Blade-holders 5 and 6 are of totally conventional type and the optimised tightnesses sought for are achieved by complementary means.

Thus, the means designed to achieve tightness at the level of the longitudinal edges of the blown tonal blades are formed here by walls 21 of the wind chest that are locally sufficiently close to one another to be located substantially in the continuation of the corresponding lateral faces of the window through which the tonal blade concerned oscillates.

The tightness at the level of the free end of the tonal blades is provided by wall 22 constituting the back of the air channel, advantageously curved both to snugly follow the curved path described by the end of the tonal blade during its oscillations thereby optimising the air-tightness, and also to form a deflector optimally performing orientation and delivery of the air flow blown by the player in the direction of the end zone of the blade.

As far as the sucked tonal blades are concerned, the tightness at the level of the longitudinal edges of said blades is provided by an additional plate 61 pressed against the bottom face, and therefore against the air inlet face of the blade-holder concerned 6. Additional plate 61 is of sufficient thickness for the free end of the tonal blades not to extend beyond the bottom face of said additional plate when oscillating. Windows are arranged though this additional plate 61, the lateral faces of which windows are substantially coplanar with the corresponding lateral faces of the windows arranged through blade-holder 6. Face 610 of the windows arranged in additional plate 61 situated facing the free end of the tonal blades is advantageously inclined and curved to snugly follow the curved path described by the end of the tonal blades when the latter oscillate, thereby guaranteeing enhanced tightness against air leaks.

FIGS. 11 to 14 show another embodiment of a blade-holder supporting ten blown tonal blades achieved by stacking six plates of equal thickness and of different lengths. This stepped design enables a flat face to be obtained over the whole length of blade-holder 7 on the air inlet face side to prevent air leaks at the level of the assembly between said air inlet face and the corresponding bearing face of the wind chest of the harmonica.

Another advantage of this stepped design is the fact that the bass and therefore long tonal blades can benefit from walls extending sufficiently high on the sides and sufficiently far at the level of the end of the blades to ensure optimum tightness despite their large oscillation amplitude, without the treble and therefore short blades being too enclosed to be able to let the air escape.

To do this, a first plate 7.1 extends over the whole length of blade-holder 7 and only comprises windows positioned facing corresponding mouthpiece holes of the wind chest, and two additional notches 7109 and 7110 in which the extra thicknesses formed by the fixing rivets the fixing lugs of tonal blades 709 and 710 are housed. The second plate 7.2 also extends over the whole length of blade-holder 7. It also comprises the ten windows corresponding to the ten tonal blades and further acts as blade-holder for tonal blades 709 and 710 which are fixed against its face directed towards the air inlet face.

Plate 7.3 is of smaller length than the previous two as its end is located between the window of blade 708 and the window of blade 709. This plate 7.3 constitutes the blade-holder of tonal blades 707 and 708 supplied by air flows S7 and S8.

Incremental stacking as described in the foregoing continues for the following plates, plate 7.4 the end of which is located between blades 706 and 707 acting as blade-holder for tonal blades 705 and 706 supplied by the corresponding flows S5 and S6, plate 7.5 the end of which is located between blades 704 and 705 acting as blade-holder for tonal blades 703 and 704 supplied by the corresponding flows S3 and S4, and plate 7.6 the end of which is located between blades 702 and 703 acting as blade-holder for tonal blades 701 and 702 supplied by the corresponding flows S1 and S2.

This blade-holder design achieved by stacking of plates is very advantageous as it enables blade-holders with very good performances technically speaking to be produced economically by simply cutting sheet metal plate edges, and as it further enables immediate and direct access to the tonal blades by unstacking the plates, moreover enabling only the blade-holder plate concerned to be changed in the event of malfunctioning of a tonal blade.

FIGS. 15 to 18 show a blade-holder 8 supporting ten sucked tonal blades supplied by the ten sucked air flows numbered from A1 to A10. This blade-holder 8 is achieved by stacking six plates of equal thickness and of different lengths. This blade-holder 8 constitutes the logical complement to blade-holder 7 shown in FIGS. 11 to 14 to equip a 10-hole diatonic harmonica comprising two blade-holders. All the sucked vibrating tonal blades supported by this blade-holder are here fixed on the one, 8.1, of the plates forming said blade-holder that is closest to the wind chest against which it rests according to the plane P8.

These two blade-holders represented in FIGS. 11 to 18 can naturally both support both blown tonal blades and sucked tonal blades each of which, according to its type, blown or sucked, and its length, itself in direct correlation with its sound height, would then advantageously be fixed on the one of the plates constituting said blade-holders that is best positioned in terms of distance with respect to the corresponding bearing faces of the wind chest.

FIGS. 19 to 28 show two blade-holders one supporting the ten sucked blades and the other the ten blown blades of the instrument. Each of the blade-holders is made from a plate the thickness of which decreases gradually from the bass notes to the treble notes, which enables a blade-holder to be obtained the thickness of which at the level of the peripheral edges of the windows through which the vibrating blades oscillate is in logical relationship with the amplitude of the oscillations of said blades which are themselves directly related to their free length.

As can be seen in FIGS. 24 to 28, the treble sucked blades are positioned closer to the bearing face of the blade-holder against the corresponding face of the reed comb or wind chest than the bass sucked blades. It then results that at least some if not all of the sucked treble blades supported by this blade-holder are therefore positioned closer to the longitudinal mid-plane Px of the instrument than the bass blades supported by this same blade-holder, which constitutes an advantage for these sucked treble blades that are always difficult to make vibrate.

FIGS. 29 to 33 show a blade-holder made from a plate the thickness of the edge rim of the lateral edges of which and/or of the wall of the window located facing the vibrating end of the blade is reduced by grooves, or spot facings. It can be seen that these grooves or spot facings are more and more deep when moving away from the bass notes associated with long blades towards the short treble blades for the reason explained above.

Figure 34:
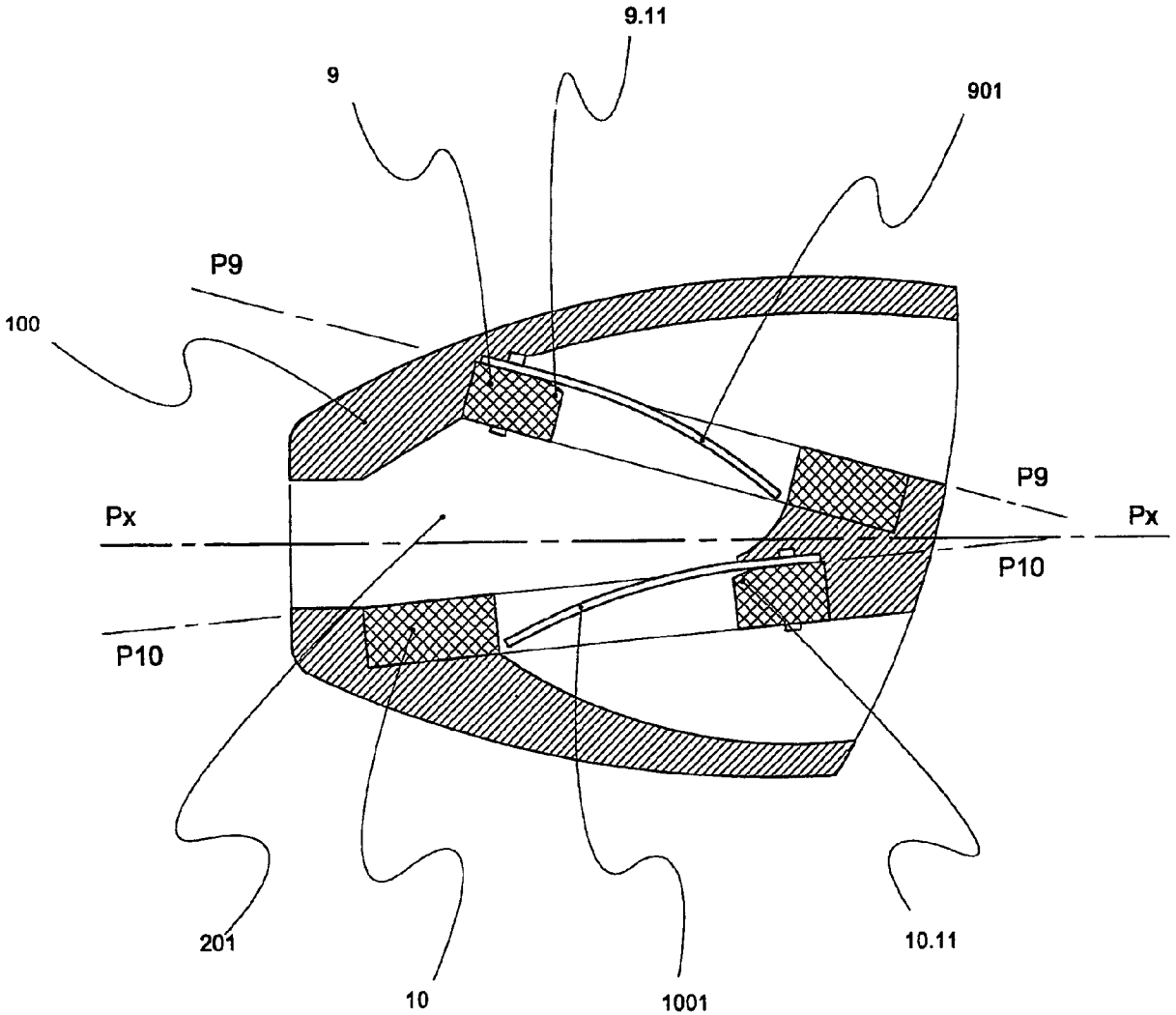

FIG. 34, 35, 36 shows a particular embodiment in which the two blade-holders 9 and 10 are arranged obliquely with respect to the longitudinal mid-plane Px so that the planes P9 and P10 passing via their faces oriented towards the outlet side of the air which passes through their respective windows form a dihedron open on the mouthpiece side of instrument 1. According to an important feature, vibrating tonal blades 9.1 and 10.1 are here fixed against the face of the blade-holder, respectively 9 and 10, oriented towards the outlet side of the air passing through the windows of said blade-holder. The corner, respectively 9.11 and 10.11, of the face of the window situated between the fixing rivet of the blade and the vibrating free part of the blade is advantageously chamfered to prevent any damage to the tonal blade which could result in a beginning of breaking during its oscillation movements.

Each of the two blade-holders 9 and 10 is moreover made here from a single plate of sufficient thickness for the faces formed by the edges of the window concerned to be sufficiently high for the longitudinal sides and the end of the free part of said tonal blade to remain enclosed in the thickness of said window, not extending beyond the air inlet face of the blade-holder concerned throughout the time when, during its oscillations, said blade is in the space comprised between its fixing plane and the plane passing via the air inlet face of the blade-holder concerned, as represented in fine lines for the active tonal blade respectively 9 in FIGS. 20 and 10 in FIG. 21.

FIG. 34 shows the characteristic positions of blown blade 9 and sucked blade 10 at rest when no air flow is circulating in air channel 201.

Figure 35:
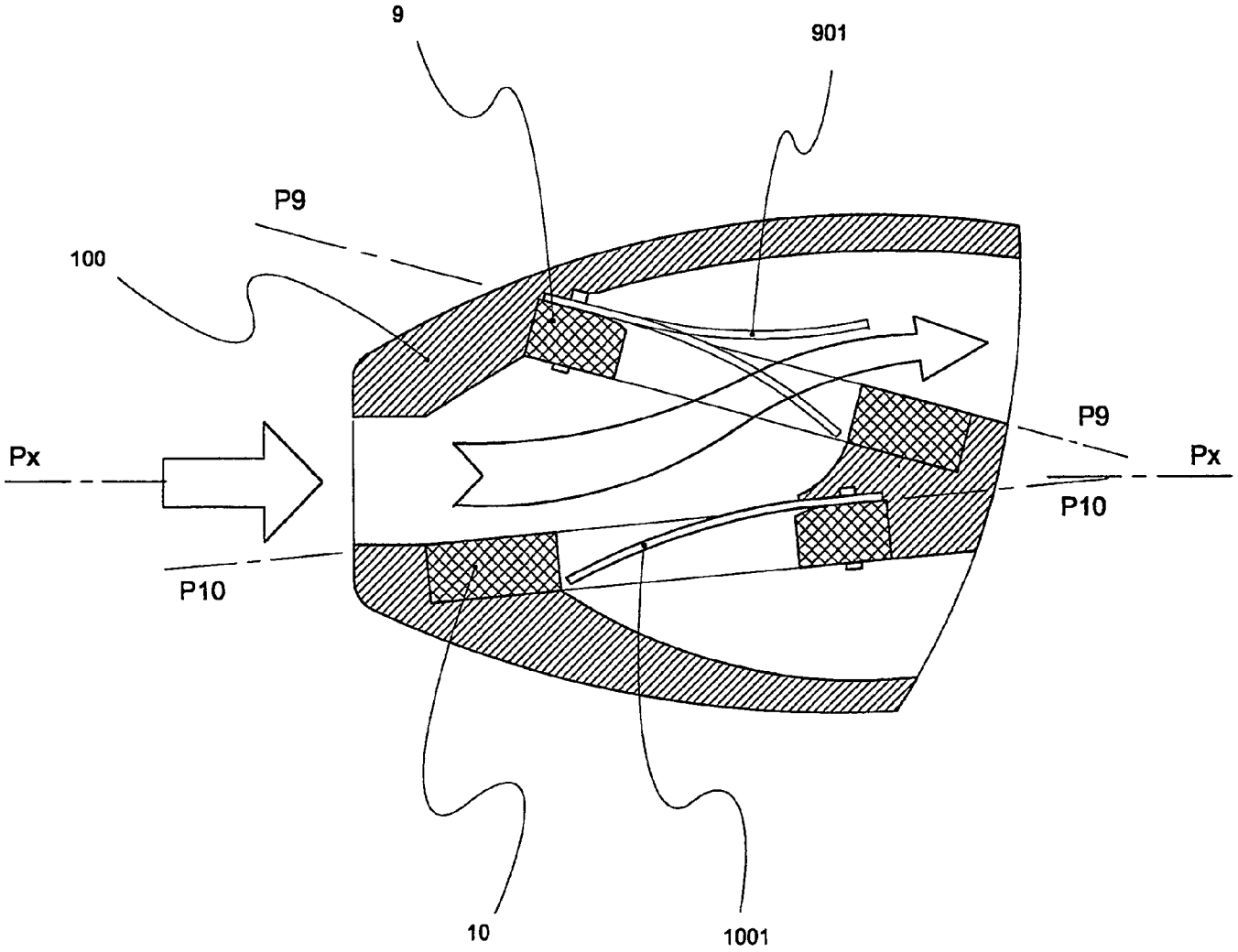

FIG. 35 shows the path of the blown air flow which activates blown blade 9.1 to make the latter oscillate between its two extreme positions represented in fine lines.

Figure 36:
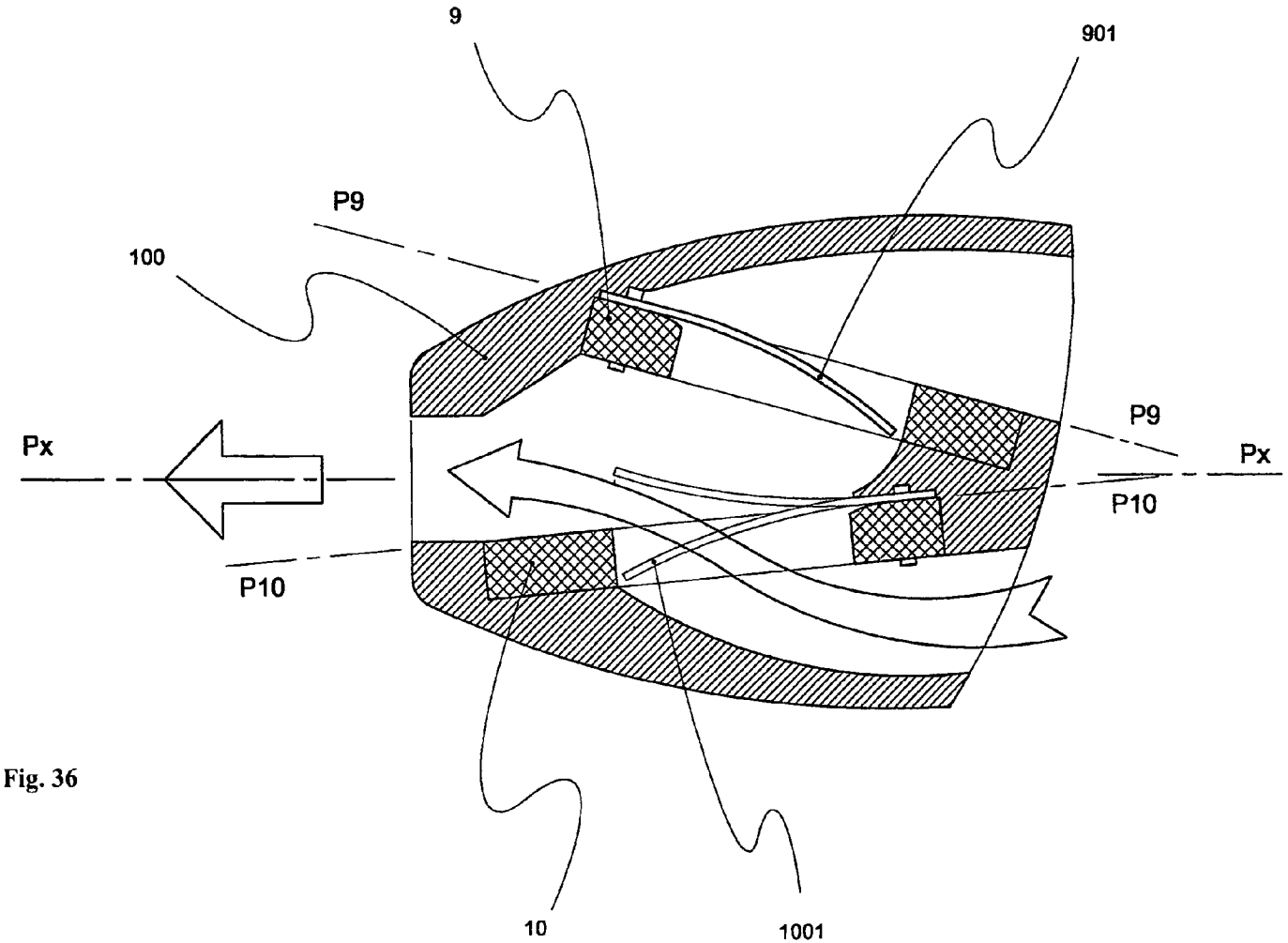
Figures 37, 38, 39, 40, 41:
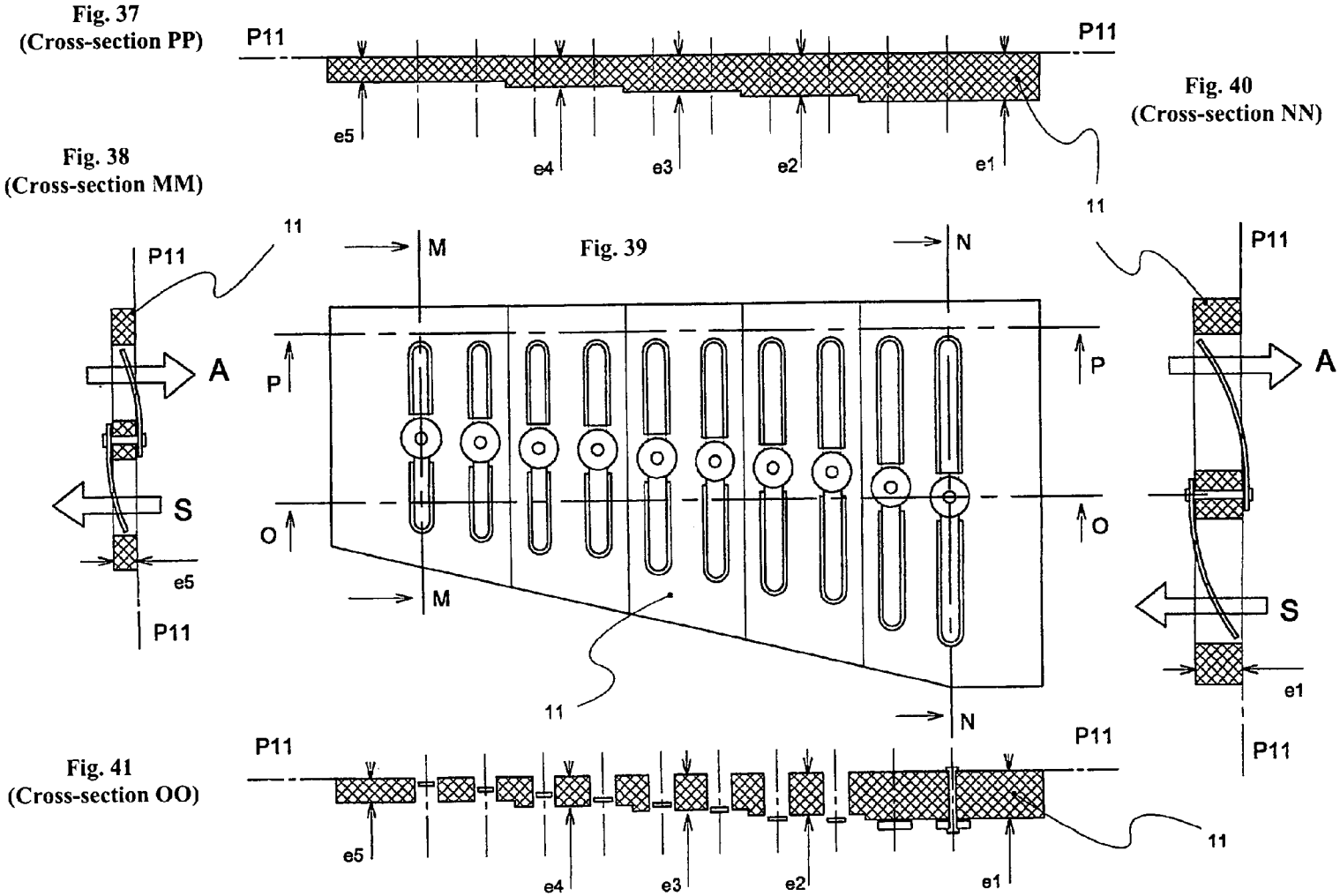
Figure 42:
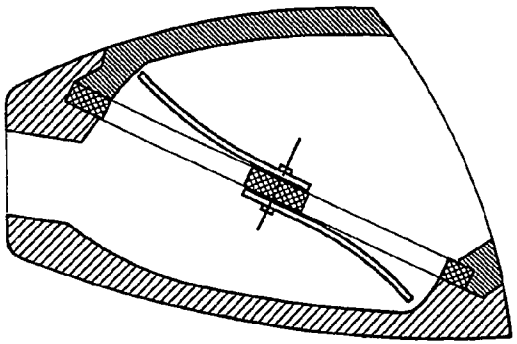

In the same way, FIG. 36 shows the path of the blown air flow which activates sucked blade 10.1 to make the latter oscillate between its two extreme positions represented in fine lines.

The advantage of the inclination of blade-holder 9 and 10 with respect to longitudinal mid-plane Px can be understood, as it enables the blown or sucked air flows to follow a path that only imposes slight changes of direction, which preserves all their force to animate thick therefore solid tonal blades generating a powerful sound.

FIGS. 37 to 41 show a particular embodiment of a single blade-holder 11 supporting all the blown tonal blades and all the sucked tonal blades of the instrument. These blades can either be fitted in conventional manner, as shown in cross-section 42, i.e. then being fixed against the face of the blade-holder oriented towards the air inlet face for the blade concerned, but these blades can advantageously be fitted in reverse manner, i.e. being fixed against the face of the blade-holder oriented towards the air outlet face for the blade concerned as represented in FIGS. 43 to 51. In this embodiment, each of the ten mouthpiece holes supplies a blown blade and a sucked blade the respective longitudinal axes of which are aligned, and the two blades are fixed to blade-holder 11 by a single rivet sandwiching said blade-holder between the fixed parts of the two tonal blades.

Blade-holder 11 is formed here by a single plate thinned in steps to go from a thickness e1 at the level of the bass blades to a much smaller thickness e5 at the level of the treble blades. It should be noted that the thickness of the blade-holder can be reduced by successive steps between each window or every two windows as represented in these figures, or even every three or every four windows. The thickness of the plate constituting the blade-holder can also be reduced continuously and decreasingly either in the form of an inclined plane therefore giving it a beveled shape and/or in the form of locally concave zones or surfaces or in the form of locally convex zones or surfaces which thin it down from the thickness it has at the level of the bass blades to a reduced thickness at the level of the treble notes.

The outer contour of blade-holder 11 is here of globally trapezoid shape to reduce its overall size and the corresponding material cost as far as possible.

Figure 44:
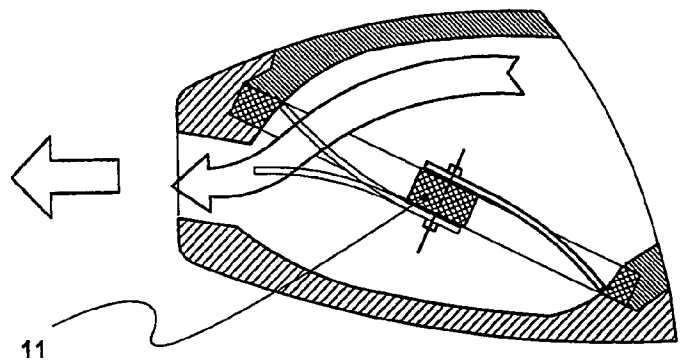
Figure 43:
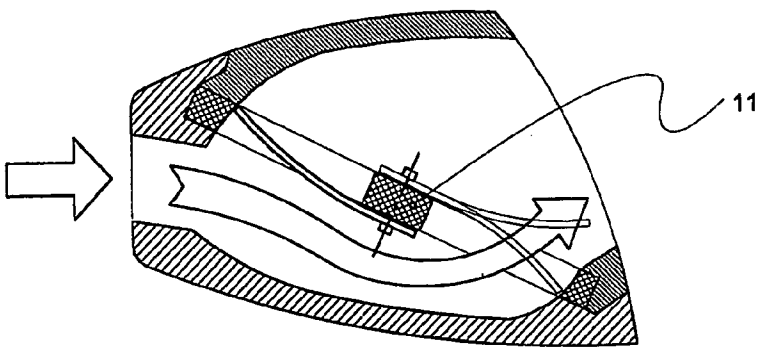

FIGS. 43 and 44, which are cross-sections along the references RR of FIGS. 48 to 51, show operation of the harmonica respectively when blowing and when sucking.

Figures 45, 46, 47:
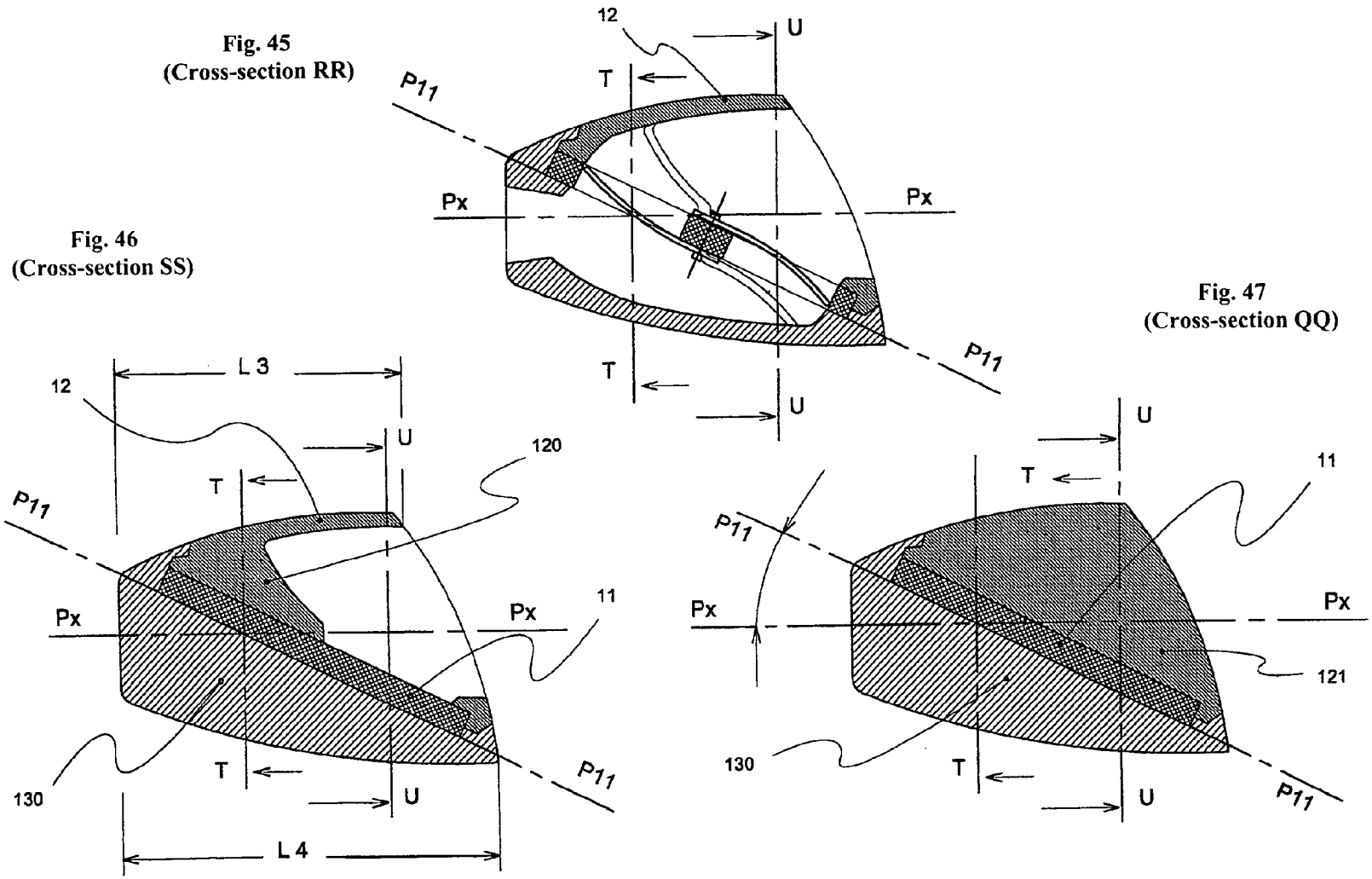

FIG. 45 is a cross-section along RR of FIGS. 48 to 51 showing the characteristic positions of the two blades supplied by one and the same air channel when they are at rest.

FIGS. 46 and 47, which are cross-sections along the references SS and QQ of FIGS. 48 to 51, show that the single blade-holder 11 is sandwiched between the bearing faces formed by the edges of the walls 130 separating the air channels from one another and the walls 120 and 121 securedly affixed to top cover 12 itself being pushed and pressed against walls 130 of the wind chest by screws 122 passing right through top cover 12 and blade-holder 11 and being screwed into main body 13 of the harmonica, constituting an advantageously monolithic assembly with the wind chest and its walls 130. The vertical axial planes of walls 120 and 121 securedly affixed to top cover 12 are arranged in parallel manner and even advantageously in the continuation of the vertical axial planes of the corresponding air channel separation walls 130. Certain of the vertical walls securedly affixed to top cover 12 bearing reference numbers 121 extend over a part of the width of blade-holder 11 only in order to enable a better sound diffusion due to larger openings in the direction of the resonator of the instrument. Other vertical walls securedly affixed to top cover 12 bearing reference numbers 121 extend for their part up to the resonator of the instrument to give the top cover the required rigidity for it to be able to press blade-holder 11 efficiently against the wind chest without deforming too much.

As shown in FIG. 47, the single blade-holder 11 is inclined with respect to the longitudinal mid-plane Px by a angle (Alpha) advantageously comprised between 0° (zero degrees) and 45° (forty-five degrees) preferably comprised between 10° (ten degrees) and 35° (thirty-five degrees) and in particular comprised between 15° (fifteen degrees) and 30° (thirty degrees), the latter range of angles representing the best trade-off between incidence of attack against the tonal blades of the sucked and blown air flows and angle of reverberation and projection of the sounds against the arch formed by the inner face of the top cover and the external dimensions of the instrument.

As shown in FIGS. 48, 49 and 50, the complementary tightness means required at the level of the sides and the free ends of the tonal blades are achieved here by the corresponding air channel separation walls 130 and walls 120 and 121 of cover 12 which are locally positioned in immediate proximity to the points via which the edges and the end of the blade concerned pass when the latter oscillate.

As shown in FIG. 46, the width of cover L3 is smaller than the width L4 of bottom element 13 forming the main body of the harmonica in order to optimise upward and forward diffusion of the emitted sounds due to a generously open resonator.

The harmonica is also of globally trapezoid shape when looked at in top view as in FIG. 50, which makes it much more ergonomic to hold than harmonicas of the prior art, the width L1 of the side of the instrument measured on the bass notes side being at least 30% (thirty percent) or even at least 40% (forty percent) larger than the width of the side of the instrument measured on the treble notes side.

Means for fixing a microphone can advantageously be arranged at the level of the resonator either on the side where the instrument is shortest, therefore on the treble blades side, or on the contrary on the bass blades side.

FIG. 51 is a view of the rear face of the instrument showing the mouthpiece zone into which the air channels open out to form the ten mouthpiece holes numbered from 1 to 10. The ten mouthpiece holes of the harmonica represented in this FIG. 51 are identical to one another.

FIG. 52 is a horizontal longitudinal cross-sectional view along the mid-plane Px showing the air flow channels according to a particular embodiment in which said channels are conical in shape, the walls that delineate them laterally not being parallel to one another as in the prior art arrangement but concurrent so that the dihedron formed by the continuation of the planes passing via said walls is a dihedron open on the mouthpiece side of the instrument. When the harmonica player blows into these air channels, this progressive conical shape of the air channel offers the advantage in comparison with the prior art arrangements of concentrating the air flow progressively in the direction of the end of the blade for a maximum thrust efficiency. The lateral flanks of the channels which are represented here as being flat can naturally also advantageously be of curved, convex or concave and in particular parabolic shape when observed in top view, the harmonica being arranged in the same position as in this view 52.

The longitudinal axes of the air channels represented in FIG. 52 are parallel to one another but they could just as easily be convergent in such a way that said axes are therefore concurrent on the mouthpiece side of the instrument or on the contrary be divergent then being concurrent on the resonator side of the instrument.

FIGS. 53 and 54 show two variants of an embodiment in which the inlet cross-section, or surface, of the mouthpiece holes supplying the treble channels is smaller than the surface of the mouthpiece inlet holes of the channels supplying the bass blades.

It should first of all be noted that in the two arrangements presented in these FIGS. 53 and 54, the distance between the axes E of the holes remains identical between the bass and treble notes and that they are of the same value as on the harmonica of the prior art so that the players can keep their marks.

Decreasing the cross-section of the inlet holes can be achieved by progressive reduction of the height of said holes, from the bass notes to the treble notes, as illustrated in FIG. 53 where the holes go from height H1 at the level of the bass notes to the smaller height H2 at the level of the trebles. As represented in FIG. 54, reducing the inlet cross-section of the mouthpiece holes from the bass notes to the treble notes can also be achieved by progressive reduction of the width of said holes that decreases from width L1 of the most bass hole to the smaller width L2 of the treble hole with the logical consequence, beneficial from the ease of playing standpoint, of progressively increasing space d1 separating the first two bass holes to a larger space d2 separating the two most treble holes.

It is also naturally possible to make this reduction of the cross-section of the inlet holes by a combination of the above two solutions by reducing both the height and width of said mouthpiece holes from the bass notes to the trebles either systematically for each of the holes or by an increment of two or more adjacent holes.

Such an arrangement with a decreasing cross-section of the inlet holes is technically interesting as it enables the large air flow necessary to animate the bass tonal blades to be achieved, which blades moreover do not require a large air pressure, unlike the treble blades which require a large pressure but a much lower flow, the latter being provided by the smaller holes supplying treble air channels which are also sufficiently small for the air pressure to be able to reach the required level almost instantaneously.

FIGS. 55 to 57 show different particular embodiments of the tonal blades in particular of the bass blades the ends of which have to be made heavier.

FIG. 55 shows a tonal blade the end of which has been folded in the form of a hook open on the air inlet face side, said hook providing the advantage of increasing the height of the end of the blade in such a way that the latter ensures an enhanced air-tightness at the level of the end of the window.

FIG. 56 shows a blade comprising transverse furrows or grooves on its face oriented towards the air outlet side. It can therefore be said that said face of the blade is not smooth as those of the prior art are but that it comprises embossments the shape and dimensions of which act on the laminar flow resulting in vibration of said blade thereby being able to modify the loudness, and the texture, of the sound emitted by said blade.

FIG. 57 shows another type of embossment in the form of a hammer also positioned on the face of the tonal blade oriented towards the air outlet side and therefore oriented towards the inside with respect to the reed comb for the sucked blades and oriented towards the outside with respect to the reed comb for the blown blades.

FIGS. 58 to 62 show different variants of a particular embodiment of execution of the blade-holder according to the invention in which, to facilitate certain playing techniques which require a great speed of execution therefore requiring the tonal blades to be made to vibrate almost instantaneously, at least some of the tonal blades, the blade-holder and/or the tonal blades concerned comprise particular arrangements designed to allow a limited and controlled flow of directed and controlled air leaks localised in the end zone of the blades designed to create very fast laminar flows to move the blades in vibration without any delay.

Figure 58:
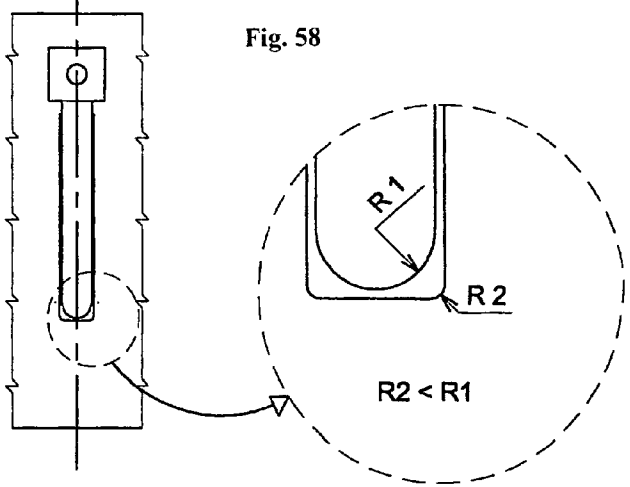

According to a first embodiment presented in FIG. 58 and in its partial enlargement, the controlled air leaks are localised in each of the two end corners of the window the radius R2 of which is smaller than the corresponding radius R1 of the tonal blade.

In FIG. 59, the width of the window through which the tonal blade oscillates is locally widened with respect to the width of the corresponding part of the tonal blade.

Thus, over a length of value L measured from the end of the window and advantageously comprised between half and twice the width of the tonal blade concerned, the space separating the edge of the tonal blade from the corresponding edge of the window and/or the space separating the end of the tonal blade from the corresponding edge of the window is at least three times greater than the value of the space measured at the half-length of said window separating the edge of said blade from the corresponding adjacent edge of the window.

In FIG. 60 it is the end of the tonal blade that is reduced in width in such a way that the same values are observed as those given above for FIG. 59.

In FIG. 61, the tonal blade comprises a notch arranged through its end edge.

In FIG. 61, the tonal blade comprises a hole made through its thickness whereas the window of the blade-holder comprises two curved notches arranged through said blade-holder on each side of the lateral edges of the end zone of the blade.

FIGS. 63 to 65 show different cross-sections of tonal blades.

FIG. 63 shows a tonal blade comprising a central groove on its face oriented towards the blade-holder and therefore on the air outlet side, the longitudinal axis of which groove can advantageously be coplanar with the longitudinal axis of said blade. This longitudinal groove serves the purpose in particular of facilitating flow of a thin stream of air oriented towards the free end of the tonal blade concerned.

FIG. 64 shows a blade of substantially triangular shape comprising two lateral bevels designed to facilitate lateral laminar air flows.

FIG. 65 shows a blade comprising two longitudinal grooves which can be arranged either parallel to one another or on the contrary convergent or divergent in the direction of the free end of the tonal blade concerned.

FIGS. 66 to 69 show a first assembly of a tonal blade on a blade-holder according to the invention to which it is fixed by fixing means directly integrated in said blade-holder and which, with the latter, form a monolithic assembly able to be manufactured directly when said blade-holder is moulded. This arrangement provides a great ease of initial assembly while at the same time offering the possibility of subsequently changing the tonal blade concerned when the latter is damaged, without requiring any tools, which is a great advantage compared with blade-holders of the prior art on which the blades are riveted or welded.

These fixing means are formed by means for guiding in translation in the longitudinal direction of the blade collaborating with means for immobilising said blade in translation. Precise guiding of the blade in longitudinal or axial translation, therefore with a single degree of freedom, is performed on the one hand by means arranged laterally on each side of the blade and on the other hand by bearing means arranged above the blade and wedging means arranged underneath said blade. This set of means together perform precise axial guiding of the fixed part of this blade in longitudinal translation in the direction of its longitudinal axis while at the same time preventing any other movement in the horizontal plane and/or in the vertical plane. The lateral guiding means serve the purpose of ensuring that the longitudinal axis of said blade is permanently coplanar with the longitudinal axis of the window concerned, whereas the bearing means and wedging means in the vertical direction serve the purpose of guaranteeing precise heightwise positioning of the fixed part of the blade in the ideal position with respect to the blade-holder required for its satisfactory operation. Means for immobilising in translation collaborate with the above-mentioned means for guiding and for axial guiding to position and hold the blade in the required position for its free end to be situated at the right distance from the end of the window concerned.

According to a preferred embodiment, the means for guiding the blade in axial translation consist of a tunnel formed by a groove, at least a part of the length of which is in the shape of a reversed U closed at the top and open at the bottom through the thickness of the blade-holder, whereas at least another portion of said groove is in the general shape of a U open at the top and closed at the bottom. The width of the groove is adjusted precisely to the width of the blade concerned to ensure perfect axial guiding of said blade without clearance. To prevent any unscheduled translation of said blade when the latter has reached its exact position, at least one pin, boss, or spigot, integral to the blade-holder or wind chest, collaborates with a hole arranged though the blade or with at least one notch or on the contrary at least one salient protuberance or cheek arranged on at least one longitudinal edge of the fixed part of the blade. According to an alternative embodiment, immobilisation of the blade in axial translation is performed by a flexible lug cut in the periphery of the fixed part of the blade, which lug wedges itself against an obstacle of ideal shape, integral to the blade-holder, positioned with precision at the required location to guarantee correct positioning of the blade in the axial direction with respect to the window through which its free part oscillates.

According to this first preferred assembly mode, the blade is moved to its precise working position by translation through the tunnel for guiding in translation formed by the succession and alternation of the portions of upwardly-open U-shaped groove. The width of the tunnel is adjusted precisely to the width of the blade concerned so that the vertical lateral edges of the sections of U-shaped groove and the vertical lateral edges of the sections of reverse U-shaped groove are positioned in contact against the longitudinal edges of said blade performing precise axial guiding of the latter in the horizontal plane. The respective altitudes of the levels of the bottoms of the sections of U-shaped groove and those of the peaks of the sections of reverse U-shaped groove which form the tunnel are designed to be adjusted to the thickness of the tonal blade to ensure clearance-free positioning in the vertical plane of the fixed part of the tonal blade, being if necessary slightly offset with respect to one another in the form of a zigzag in the vertical direction to apply a slight alternate bending stress on said fixed part of the tonal blade in the longitudinal direction.

As soon as the blade has been moved to its working position, its end lifts up on account of the bending strain so as to be able to pass over the top face of the spigot which houses in the corresponding hole of the blade as soon as the latter has reached its working position.

Thus, as represented in the different views 66 to 69, the fixing means therefore comprise at least vertical flanks performing lateral wedging operating in conjunction with at least three alternate contact points acting in opposite vertical directions associated with a securing part to which the free part of the tonal blade positioned opposite the vibrating free part of said blade is secured by applying a slight bending strain.

These figures further show that, on the blade-holder air outlet face side, the length L of the window through which the tonal blade oscillates, measured in the axial direction of the tonal blade, is reduced to a value d2 that is smaller than L. A joining wall 800 passing through the whole width of the window and arranged here in the thickness of the blade-holder, in fact extends on the blade-holder air outlet face side in the longitudinal direction of the window over a certain length thereof from the end of said window situated on the same side as the fixed part of the blade. This wall 800, arranged between the vibrating part of the blade and the face of the blade-holder on the air outlet side, is naturally of sufficiently small thickness for the face of this wall 800 situated on the air inlet side of the blade-holder to be situated before the space swept by the vibrating part of the blade so that there is no contact between the latter.

According to an advantageous embodiment, the length d2 of the window measured at the level of the face of the blade-holder via which the air escapes is smaller than three quarters of the length L of the window measured at the level of the face of the blade-holder via which the air enters said window. According to a preferred embodiment, the length d2 of the window is smaller than two thirds of the length L of the window, and according to a particular embodiment, the length d2 of the window is smaller than three fifths of the length L of said window.

FIGS. 70 to 73 show another embodiment of a blade-holder according to the invention in which the means for axial guiding of the blade are completed by a counter-blade 990 of slightly conical shape designed on the one hand to absorb the vertical clearance between the top face of the tunnel and the thickness of the blade so as to keep the top face of the fixed part of the blade pressed against the bottom face of the guiding tunnel in which it is slid, and on the other hand to provide a rigid bottom support for the vibrating part of the blade in spite of the overhang due to the distance from the bottom support point on which the fixed part of the tonal blade presses.

According to another important feature of this embodiment, on the same side as the inlet face of the air passing through the blade-holder, for at least some of the tonal blades of the instrument, the opening of the window is reduced in length by a bridge 991 joining the two sides of said window straddling the space in which the vibrating part of the blade is located. On the vibrating blade side, the bottom face of this bridge 991 is formed by two walls arranged substantially in the vertical continuation of the lateral faces of the window through which the vibrating part of the tonal blade oscillates, said walls of the bridge then being joined to one another by an arch advantageously that is curved in the transverse direction of the blade but which could also be straight and parallel to the face of said blade. As shown in particular in FIG. 72, in the longitudinal direction of the tonal blade, the bottom face of the bridge is advantageously curved and advantageously parabolic in the form of a resonator open in the direction the vibrating free end of the tonal blade to ensure projection and amplification of the sound vibrations emitted by said blade, bridge 991 of which constitutes an acoustic mirror.

In the longitudinal direction of the vibrating blade, it can be seen that, the closer one is to the vibrating free end of the blade, the farther the bottom face of said bridge 991 located on the same side as the vibrating part of the blade moves away from the plane passing through the face against which the tonal blade concerned is fixed, said bottom face of bridge 991 therefore being arranged obliquely.

According to a particular embodiment, the faces of said bridge 991 located on the same side as the vibrating part of the blade can advantageously be coated with a smooth hard material such as for example a chromium-plating, to further improve the acoustic reverberation of said bridge.

In this embodiment, for at least some of the tonal blades, the length d1 of the opening through which the air enters before animating the vibrating blade is shorter than the length L of the window arranged in the blade-holder, which length L moreover here corresponds substantially to the length of the free part of the tonal blade, and therefore to the length of the vibrating part of said blade.

According to an advantageous embodiment, the length d1 of the opening through which the air enters is less than three quarters of the length L of the air passage measured at the level of the face of the blade-holder against which the tonal blade concerned is fixed.

According to a preferred embodiment, the length d1 of the opening is less than two thirds of the length L of the window, and according to a particular embodiment, the length d1 of the opening is less than three fifths of the length L of said window.

FIGS. 74 to 78 show an alternative embodiment of a blade-holder equipped with a bridge 992 as described in the foregoing for FIGS. 70 to 73, but bridge 992 is formed here by a joining wall extending obliquely in the longitudinal direction of the tonal blade and extending horizontally in the transverse direction of said blades, said joining wall extending in continuous manner between two adjacent blades.

These figures show another method for fixing the tonal blades onto the blade-holder. The means for guiding the blades in axial translation are formed here by tunnels which are closed on the four sides and have passage dimensions adjusted with that of the cross-section of the tonal blade concerned, whereas the means for immobilising in translation are formed by a rivet, a screw or a simple spigot in the form of a pin on which the blade latches after its free end situated on its fixed part side, and therefore situated opposite its other vibrating free end, has been lifted to pass over said pin which is then housed in the corresponding hole arranged in the blade.

According to an alternative embodiment of this method for fixing the tonal blades onto their blade-holder, not represented in these drawings, at least a part of the fixed part of the tonal blade is conical in the vertical direction and/or in the horizontal direction, i.e. in the direction of its thickness and/or in the direction of its width, and it collaborates with a suitable cross-section of tunnel that is also advantageously conical, so that the axial translation of the blade to bring the latter to the working position enables it to wedge perfectly and without clearance in the tunnel constituting a sleeve, both in the lateral direction and in the vertical direction.

According to a first embodiment of this variant, the width and/or thickness of at least a part of the fixed part at least of the blade decreases the closer one is to its vibrating free end, and to be fitted on the blade-holder, the blade is then placed by axial translation in the direction going from the fixed part of the blade to the vibrating free end of said blade before being immobilised in translation by securing means formed by obstacles of complementary shapes arranged on or in the blade and/or arranged on or in the blade-holder and/or on or in the wind chest and/or on or in the cover concerned and/or against or in the inside face of the main body of the harmonica.

According to another embodiment, the width and/or thickness of at least a part of the fixed part at least of the blade decreases the farther one is from its vibrating free end, and to be fitted on the blade-holder, the blade is then placed by axial translation in the direction going from the vibrating free end of said blade to the fixed part of the blade before being immobilised in translation by the securing means described above.

According to another feature, a part of the length of the fixed part of the blade can advantageously be thinned to facilitate longitudinal bending thereof so that it can moved in translation to be latched onto the securing means.

According to another alternative embodiment, the tonal blades are fixed to the blade-holder by bosses, pins or rivets that are either hot-crushed or crushed by means of an ultrasonic rivet set, said bosses, pins or rivets being advantageously moulded at the same time as the blade-holder with which they form a monolithic assembly made from thermoplastic or thermosetting material, whereas the tonal blades can be made either from metal alloys or from composite alloys composed of fibres sunk in synthetic resins or be made from a thermoplastic material that can be fixed to the blade-holder either by sticking or by ultrasonic welding.

Figure 77:
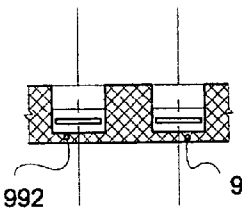
Figure 77:
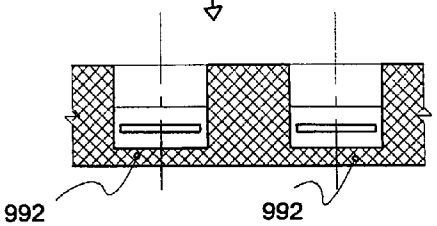
Figure 74:
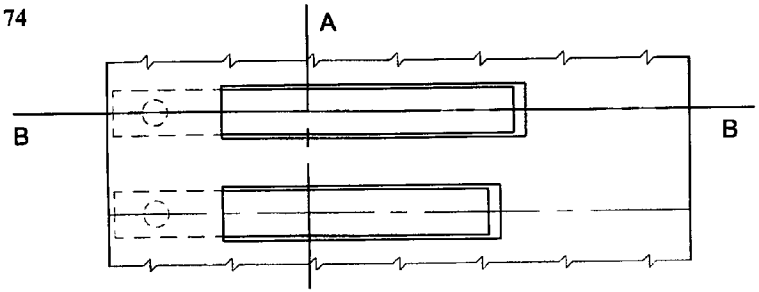
Figure 75:
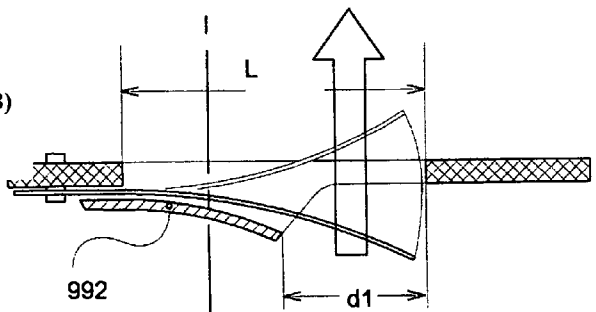
Figure 76:
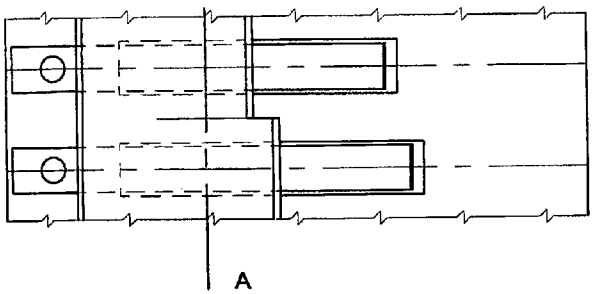

As shown by FIG. 77 for two adjacent blades, on a part of their length, each of the windows through which the tonal blades oscillate are of U-shaped cross-section open on the side where the blade vibrating concerned is located.

FIG. 78 shows a harmonica equipped with two blade-holders identical to those presented in FIGS. 74 to 77 in cross-section. It can be seen that for the top blade-holder which supports the blown blades, on the air inlet side, the opening of at least some of the windows through which the blown blades oscillate is of smaller length than the opening through which the air exits from the blade-holder. The same is the case for the bottom blade-holder which supports the sucked tonal blades. However as can be observed, the joining bridge reducing the length of the windows is on the other hand positioned inside the reed comb, in the air channel concerned for the blown blades, whereas it is situated outside the blade-holder and therefore outside the reed comb or wind chest for the sucked blades.

This FIG. 78 shows in obvious manner the advantage of said bridges which firstly act as deflectors by directing the air flow in the direction of the vibrating free end of the blades both for the sucked blades and for the blown blades. The blown blade blade-holder bridge located inside the air channel concerned moreover contributes to beneficially speeding up the air flow and to increasing the air pressure at the level of the vibrating end of the blown blades due to the progressive conical reduction of said air channel by said bridge. This bridge joining the two edges of the window over a part of the length of said window moreover contributes greatly to limiting air leaks at the level of the vibrating part of the blade situated near the fixing zone of said blade.

FIGS. 79 to 82 show a preferred embodiment in which, for at least some of the tonal blades, the inlet and outlet openings of the air passing through the window through which the vibrating part of the blade concerned oscillates are of lengths, respectively d1 and d2, that are smaller than the length L of the air passage measured at the level of the face of the blade-holder against which the tonal blade concerned is fixed.

According to an advantageous embodiment, the length d2 of the opening through which the air exits after it has passed through the window is smaller than three quarters of the length L of the air passage measured at the level of the face of the blade-holder against which the tonal blade concerned is fixed. According to a preferred embodiment, the length d2 of said opening is smaller than two thirds of the length L of the window, and according to a particular embodiment, the length d2 of the opening is smaller than three fifths of the length L of said window.

In this embodiment, the window through which the tonal blade concerned oscillates is partly masked or covered on the air inlet side by a first bridge 993 and partly masked or covered also on the air outlet side by a second bridge 994 the arch of which is directed towards the arch of the first bridge.

These two joining bridges joining the two longitudinal sides of the window concerned over a part of their length are in the shape of a dome or a resonator open in the direction of the vibrating free end of the blade, and they are therefore advantageously of globally elliptic or even parabolic shape.

The first bridge located on the air inlet side is of flared shape in the horizontal plane and in the vertical plane so that its width and height are increasing the closer one goes to the vibrating free end of the blade. The legs of the first joining bridge forming the resonator 993 located on the air inlet side are not located in the vertical continuation of the lateral faces of the window, whereas those of the second bridge forming the resonator 994 located on the air outlet side are.

The particular arrangements formed by these resonators have the main purpose of acting as resonator, as an amplifier to amplify the sound volume of the tonal vibrations emitted by the tonal blade concerned, and they also serve the purpose of preventing any air leaks by creating obstacles in the form of chicanes at the level of the relevant lateral edges of the window.

According to another feature of a particular embodiment able to be applied to all the foregoing, at least a part of the vibrating free part of at least some of the tonal blades of the instrument and also naturally the corresponding adjacent edges of the windows concerned are advantageously of trapezoid shape when they are observed in top view so that the width of said blades is then decreasing the closer one goes to the vibrating free end of said blade. This particular shape gives the blade a greater ease of bending in the end zone due to the reduced width of the blade in this zone, while at the same time strengthening the joining zone between the vibrating part and the fixed part of the blade due to an increased width of the blade in this joining zone.

The invention is naturally not limited to the embodiments shown or described in this document but it extends to encompass all the technical equivalents and combinations thereof, and it also applies to harmonicas of diatonic type and to harmonicas of chromatic type or of polyphonic or bass type.

The invention claimed is:

1. A blade-holder for a harmonica, the blade-holder comprising:

vibrating tonal blades, wherein each of the tonal blades is fixed to the blade-holder on a first end of the blade-holder;

a free part of the tonal blades being configured to oscillate through one of a plurality of windows arranged in the blade-holder due to a force of an air flow blown or sucked by a harmonica player; and a height of at least a part of at least a lateral face or of an end face of the windows through which a flexible part of treble vibrating blades of the harmonica oscillates, is smaller than a height of a corresponding zone of the window through which a flexible part of bass vibrating blades oscillates.

2. The blade-holder for the harmonica according to claim 1, wherein a thickness of the blade-holder decreases in successive steps from the bass vibrating blades to the treble vibrating blades.

3. The blade-holder for the harmonica a harmonica according to claim 1, wherein a thickness of the blade-holder progressively from the bass vibrating blades to the treble vibrating blades.

4. The blade-holder for the harmonica according to claim 1, wherein a thickness of edges of lateral sides of at least some of the windows and/or a thickness of the edge of the window facing a vibrating end of the tonal blades is reduced by grooves or notches, the grooves or notches of the treble vibrating blades being deeper than the grooves or the notches of the bass vibrating blades.

5. The blade-holder for the harmonica according to claim 1, wherein at least some of the treble vibrating blades subjected to the force from the air flow blown or sucked by the harmonica player are positioned closer to a longitudinal mid-plane of the harmonica than the bass vibrating blades supported by the same blade holder.

6. The blade-holder for the harmonica according to claim 1, wherein, for at least some of the windows through which the tonal blades vibrate, the blade-holder comprises:

a bridge joining a first side and a second side of the window, the bridge straddling a space through which a vibrating part of the tonal blades pass, and a length, measured in a longitudinal axial direction of the tonal blades, of an opening through which air enters to pass through the window, is smaller than a length of an air passage measured on a side of the blade-holder against which the tonal blades are fixed.

7. The blade-holder for the harmonica according to claim 6, wherein the length of the opening through which the air enters to animate the tonal blades is smaller than three quarters of a length of the air passage measured at a level of a face of the blade-holder against which the tonal blades are fixed.

8. The blade-holder for the harmonica according to claim 1, wherein, for at least some of the windows through which the tonal blades vibrate, the blade-holder comprises:

a bridge joining a first side and a second side of the window, the bridge straddling a space through which a vibrating part of the tonal blades pass, and a length, measured in a longitudinal axial direction of the tonal blades, of an opening through which air exits after it has passed through the window is smaller than a length of an air passage measured at a level of a face of the blade-holder against which the tonal blades are fixed.

9. The blade-holder for the harmonica according to claim 8, wherein the length of the opening through which the air exits after it has passed through the window is smaller than three quarters the length of the air passage measured at the level of the face of the blade-holder against which the tonal blades are fixed.

10. The blade-holder for the harmonica according to claim 1, wherein the tonal blades are fixed to the blade-holder by means configured to perform precise guiding of the tonal blades in an axial translation and by means configured to immobilize the translation.

11. A method of assembling the blade-holder for the harmonica according to claim 10, the method comprising:

placing the tonal blades in axial translation in a direction going from a fixed part of the tonal blades to a vibrating free end of the tonal blades; and immobilizing translation by blocking means formed by obstacles of complementary shapes arranged on or in the tonal blades, or arranged on or in the blade-holder, or on or in a wind chest, or against or in an inside face of a main body of the harmonica, or a combination thereof.

12. A method of fitting tonal blades onto the blade-holder for the harmonica according to claim 10, the method comprising:

placing the tonal blades in axial translation in a direction going from a vibrating free end of the tonal blades to a fixed part of the tonal blades; and immobilizing translation by a securing means formed by obstacles of complementary shapes arranged on or in the tonal blades, or arranged on or in the blade-holder, or on or in a wind chest, or on or in the cover concerned or, against or in an inside face of a main body of the harmonica, or a combination thereof.

13. The blade-holder for the harmonica according to claim 1, wherein at least some of the tonal blades comprise arrangements allowing directed and controlled air leaks at a level of an end zone of the tonal blades.

14. The blade-holder for the harmonica according to claim 1, wherein at least a part of a vibrating free part of at least some of the tonal blades of the harmonica and the corresponding adjacent edges of the windows concerned are of trapezoid shape when they are observed in top view so that a width of the tonal blades decreases toward a vibrating free end of the tonal blades.

15. A harmonica equipped with the blade-holder according to claim 1, wherein a surface of inlet mouthpiece holes of treble channels is smaller than a surface of inlet mouthpiece holes of bass channels, a distance between each of the inlet mouthpiece holes for the treble channels and the inlet mouthpiece holes for the plurality of bass channels remains identical.

* * * * *